US010251445B2

(12) United States Patent
McDonald

(10) Patent No.: US 10,251,445 B2
(45) Date of Patent: Apr. 9, 2019

(54) ARTICLE OF FOOTWEAR WITH IMPROVED ARCH SUPPORT

(71) Applicant: Under Armour, Inc., Baltimore, MD (US)

(72) Inventor: Steve McDonald, Park City, UT (US)

(73) Assignee: UNDER ARMOUR, INC., Baltimore, MD (US)

( * ) Notice: Subject to any disclaimer, the term of this patent is extended or adjusted under 35 U.S.C. 154(b) by 85 days.

(21) Appl. No.: 15/149,571

(22) Filed: May 9, 2016

(65) Prior Publication Data

US 2016/0324254 A1 Nov. 10, 2016

Related U.S. Application Data

(60) Provisional application No. 62/158,715, filed on May 8, 2015.

(51) Int. Cl.

| | |
|---|---|
| ***A43B 7/22*** | (2006.01) |
| ***A43B 13/18*** | (2006.01) |
| ***A43B 13/14*** | (2006.01) |
| ***A43B 7/14*** | (2006.01) |
| ***A43B 13/16*** | (2006.01) |
| ***A43B 23/02*** | (2006.01) |

(52) U.S. Cl.

CPC ..... *A43B 13/181* (2013.01); *A43B 7/1495* (2013.01); *A43B 13/141* (2013.01); *A43B 13/16* (2013.01); *A43B 23/0295* (2013.01)

(58) Field of Classification Search

CPC ..... A43B 5/0437; A43B 7/14; A43B 7/142; A43B 7/143; A43B 7/148; A43B 7/1485; A43B 7/1495; A43B 13/125; A43B 13/14; A43B 13/141; A43B 13/16; A43B 13/181; A43B 13/184; A43B 13/186; A43B 13/223; A43B 13/26; A43B 23/22; A43B 23/0295

USPC ..... 36/25 R, 30 R, 88, 91

See application file for complete search history.

(56) References Cited

U.S. PATENT DOCUMENTS 4,399,621 A * 8/1983 Dassler ..... A43B 13/14 36/114

4,785,557 A 11/1988 Kelley et al.

(Continued)

FOREIGN PATENT DOCUMENTS

| | | | | |
|---|---|---|---|---|
| DE | 102012104264 A1 * | 11/2013 | ..... | A43B 13/127 |
| FR | 2047687 A5 * | 3/1971 | ..... | A43B 13/14 |
| WO | WO 2006098811 A2 * | 9/2006 | ..... | A43B 3/0026 |

*Primary Examiner* — Jameson D Collier

(74) *Attorney, Agent, or Firm* — Edell, Shapiro & Finnan, LLC

(57) ABSTRACT

An improved article of footwear includes a midsole, an upper, and a support member. The midsole of the footwear contains a forefoot region, a heel region, a middle region. The midsole contains a medial recess and a lateral recess in the sidewall, and a central opening in the bottom surface, where the recesses and the central opening are in fluid communication with one another. The upper of the footwear is disposed on the midsole, but the bottom surface of the upper that is proximate to the central opening, the medial recess, and the lateral recess of the midsole is exposed. A support member is disposed on the bottom surface of the upper proximate to the central opening of the midsole. The support member is configured to extend from the bottom surface of the upper through the central opening of the midsole.

17 Claims, 22 Drawing Sheets

(56) References Cited

U.S. PATENT DOCUMENTS

| | | | | |
|---|---|---|---|---|
| 5,079,856 | A * | 1/1992 | Truelsen | A43B 21/26 36/25 R |
| 6,948,261 | B1 * | 9/2005 | Grasso | A43B 5/18 36/100 |
| 7,401,418 | B2 | 7/2008 | Wyszynski et al. | |
| 7,451,557 | B2 * | 11/2008 | McDonald | A43B 1/0063 36/100 |
| 7,644,462 | B2 | 1/2010 | Wyszynski et al. | |
| 7,841,105 | B2 | 11/2010 | Wyszynski et al. | |
| 7,954,257 | B2 * | 6/2011 | Banik | A43B 7/144 36/28 |
| 8,225,534 | B2 * | 7/2012 | Mueller | A43B 13/16 36/102 |
| 8,474,155 | B2 | 7/2013 | McDonald et al. | |
| 8,479,416 | B2 * | 7/2013 | Auger | A43B 7/1445 36/102 |
| 8,756,834 | B1 * | 6/2014 | Halberstadt | A43B 5/02 36/128 |
| 8,782,929 | B2 | 7/2014 | Taicher | |
| 8,919,016 | B2 | 12/2014 | McDonald et al. | |
| 2004/0148803 | A1 * | 8/2004 | Grove | A43B 13/223 36/103 |
| 2010/0077636 | A1 | 4/2010 | Wyszynski et al. | |
| 2011/0067263 | A1 | 3/2011 | Wyszynski et al. | |
| 2013/0318818 | A1 | 12/2013 | Gardiner | |

* cited by examiner

ARTICLE OF FOOTWEAR WITH IMPROVED ARCH SUPPORT

CROSS-REFERENCE TO RELATED APPLICATIONS

This application claims priority under 35 U.S.C. 119(e) to U.S. Provisional Patent Application Ser. No. 62/158,715, entitled "Article of Footwear with Improved Arch Support", filed May 8, 2015, the disclosure of which is incorporated herein by reference in its entirety for all purposes.

FIELD OF THE INVENTION

The present invention relates to an article of footwear that provides an improved fit around the arch of a foot and improved support of the arch of a foot. More specifically, the present invention relates to an article of footwear where the midsole in the arch region of the article of footwear is disconnected from the upper in the arch region of the article of footwear to allow the upper of the article of footwear to wrap around the arch of the foot.

BACKGROUND OF THE INVENTION

For typical articles of footwear, the upper extends outwardly and/or upwardly from an outer peripheral edge of the midsole and covers at least a portion of the foot to hold the footwear in place on the foot of the user. Uppers in athletic footwear are usually formed from one or more pieces of fabric, leather, and/or plastic that are stitched, bonded, or otherwise attached together. Various fasteners, including laces and hook and loop fasteners, are used to secure the foot in the cavity defined by the upper. The arch of the foot is designed to act as a spring on the foot while walking or running, reducing the risk of musculoskeletal wear or damage, and reducing the amount of energy expended when walking and running. Conventional articles of footwear may provide arch support, however, these conventional articles of footwear fail to enable the arch to function fully because they do not enable the arch of the foot to properly flex and transfer the weight of the user from the heel to the forefoot when walking or running.

In addition, conventional articles of footwear are often static in how they provide arch support to users. In other words, conventional articles of footwear cannot be changed or altered to provide varying degrees of arch support. Because the foot of one user varies so greatly to the foot of another user, a conventional article of footwear is often designed to fit a generic foot. This often results in the conventional article of footwear failing to properly fit the arch of the foot for several users. Furthermore, because conventional articles of footwear are typically constructed by the upper being bonded to thick midsoles via various layers of cushioning and glue, conventional articles of footwear are heavy and dampen and stifle the performance of the article of footwear for the user.

It would be desirable to provide an article of footwear that has improved arch support, where the article of footwear allows the arch of the foot to flex properly when a user is walking and running. It would also be desirable to provide an article of footwear where the upper is able to completely wrap around at least the midfoot region of the foot of the user. Additionally, it would be desirable to provide an article of footwear that is lightweight and provides an increased performance when running and walking.

SUMMARY OF THE INVENTION

An article of footwear includes a midsole, an upper, and a support member. The midsole of the article of footwear contains a forefoot region, a heel region, and a middle region that is disposed between the forefoot region and the heel region. The midsole further includes a bottom surface that extends from the heel region, through the middle region, to the forefoot region. The midsole further includes a sidewall. The middle region of the article of footwear further includes a central opening in the bottom surface of the midsole. Furthermore, the middle region of the article of footwear includes a medial recess and a lateral recess in the sidewall of the midsole. The central opening, the medial recess, and the lateral recess are in fluid communication with one another.

The upper of the article of footwear includes a top surface, a medial side, a lateral side, and a bottom surface. The upper is sized and shaped to define a cavity that is configured to receive a foot of the user. The bottom surface of the upper is at least partially disposed on the midsole. The bottom surface of the upper that is disposed proximate to the central opening, the medial recess, and the lateral recess of the middle region of the midsole is exposed.

The support member is disposed on the bottom surface of the upper proximate to the central opening of the middle region of the midsole. The support member is configured to extend from the bottom surface of the upper through the central opening of the midsole.

BRIEF DESCRIPTION OF THE DRAWINGS

Like reference numerals have been used to identify like elements throughout this disclosure.

DETAILED DESCRIPTION OF THE INVENTION

The present invention disclosed herein is an article of footwear that comprises of an upper, a midsole, and a support member. The article of footwear contains a forefoot region, middle region, and heel region. The upper is constructed to define a cavity for receiving a foot, where the arch of a foot disposed in the cavity of the upper is positioned proximate to the middle region of the article of footwear. The upper is disposed on the midsole of the article of footwear. However, the midsole includes a first recess and a second recess on the sidewalls proximate to the middle region of the article of footwear. Furthermore, on the bottom surface of the midsole, proximate to the middle region of the article of footwear, is a central opening. The first recess, second recess and central opening are connected, and in fluid communication, with one another to form a cavity beneath the middle region of the upper. The placement of the first recess, second recess and central opening proximate to the middle region enables the upper in the middle region to continuously wrap around the arch of the foot. Thus, the upper can then be tightened or loosened in the middle region of the article of footwear to closely wrap the upper around the arch of the foot placed within the article of footwear. The flexible and resilient nature of the upper enables the upper to at least partially support the arch of the foot, while still enabling the arch of the foot to flex during walking and running. The article of footwear may further include a support member coupled to the upper in the middle region, where the support member is configured to extend through the cavity and through the central opening in the midsole.

Figure 1:
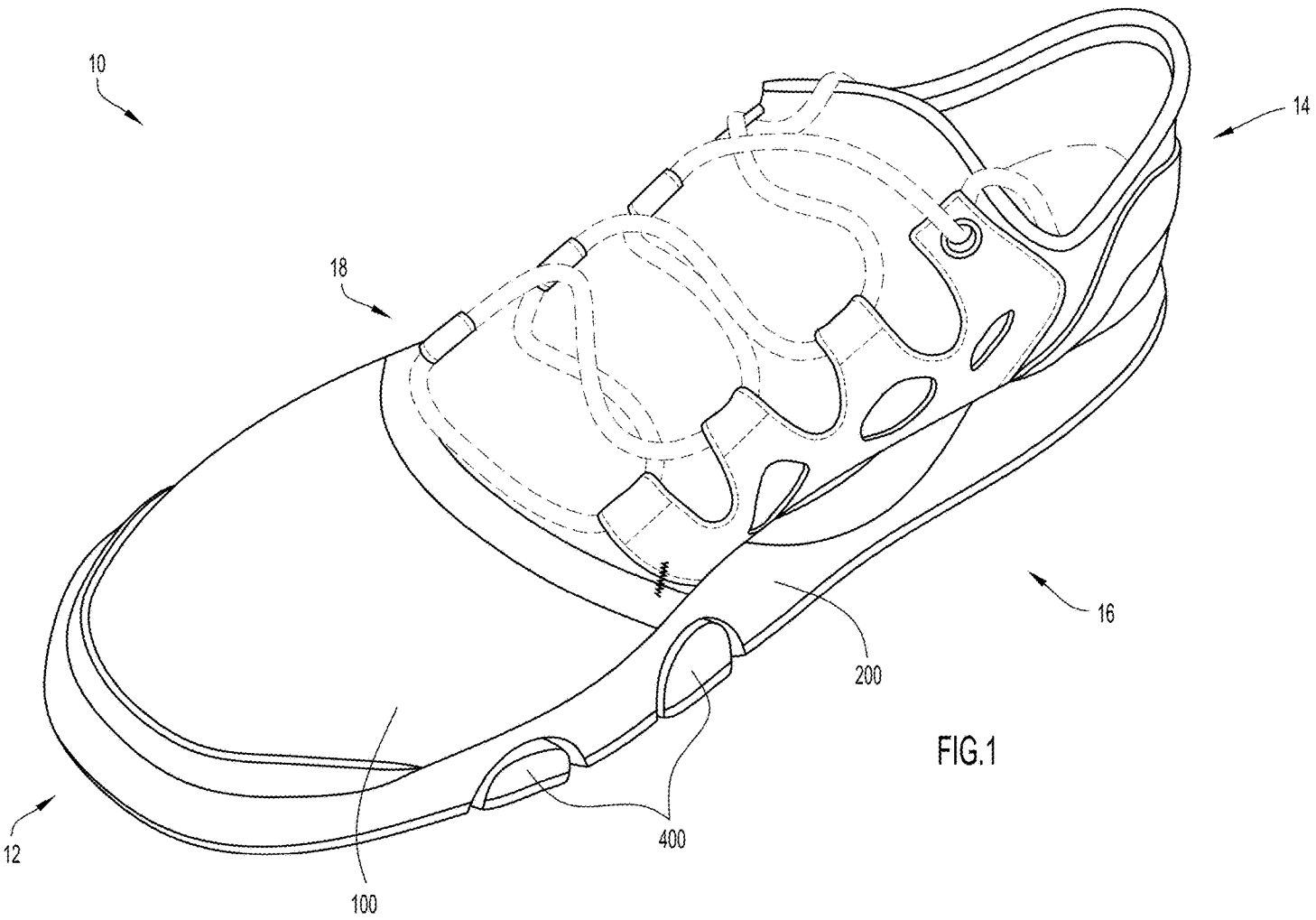
FIG. 1 illustrates a perspective view of an embodiment of an article of footwear according to the present invention.
Figure 2A:
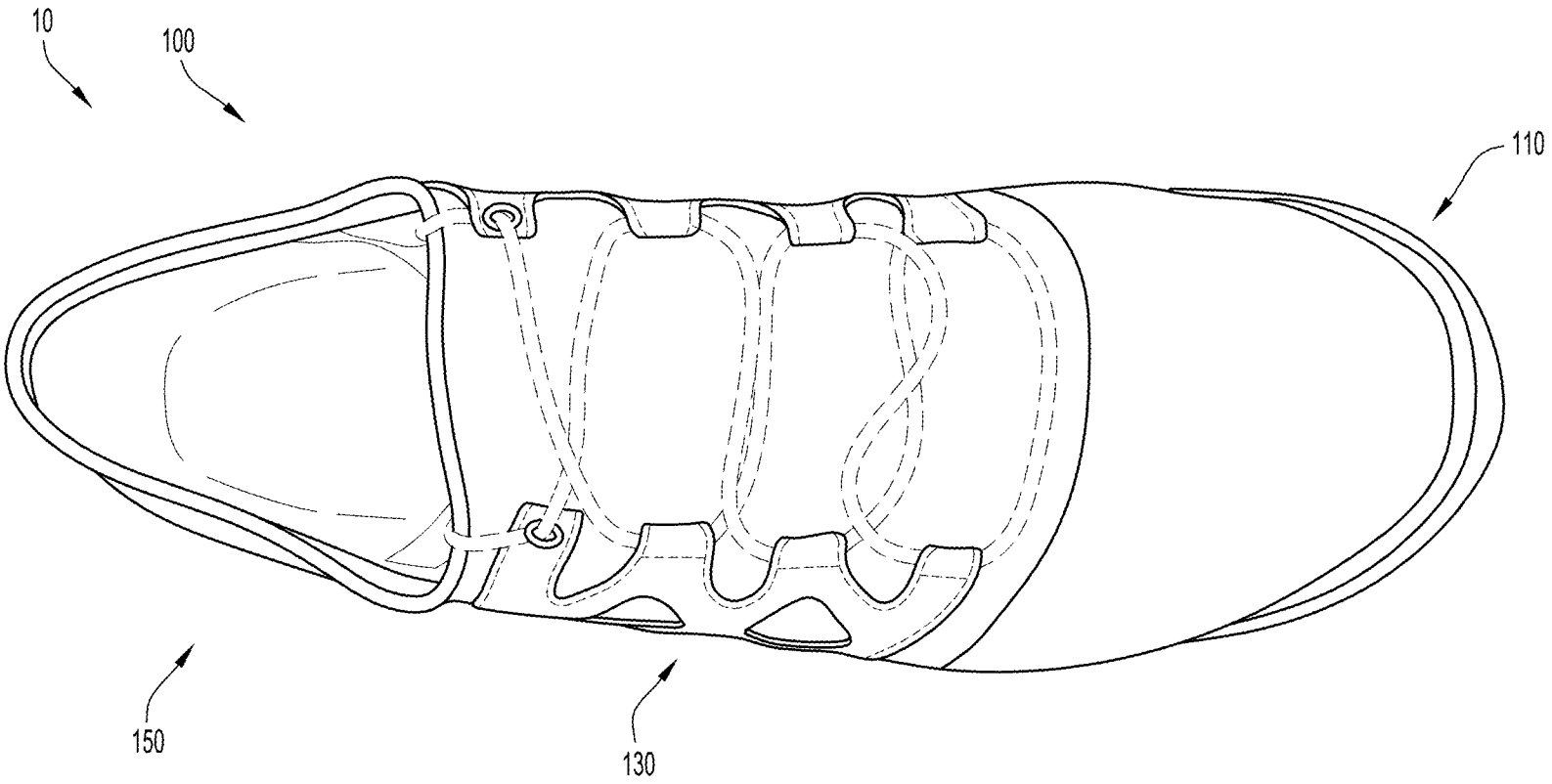
FIG. 2A illustrates a top view of the embodiment of the article of footwear illustrated in FIG. 1.
Figure 2B:
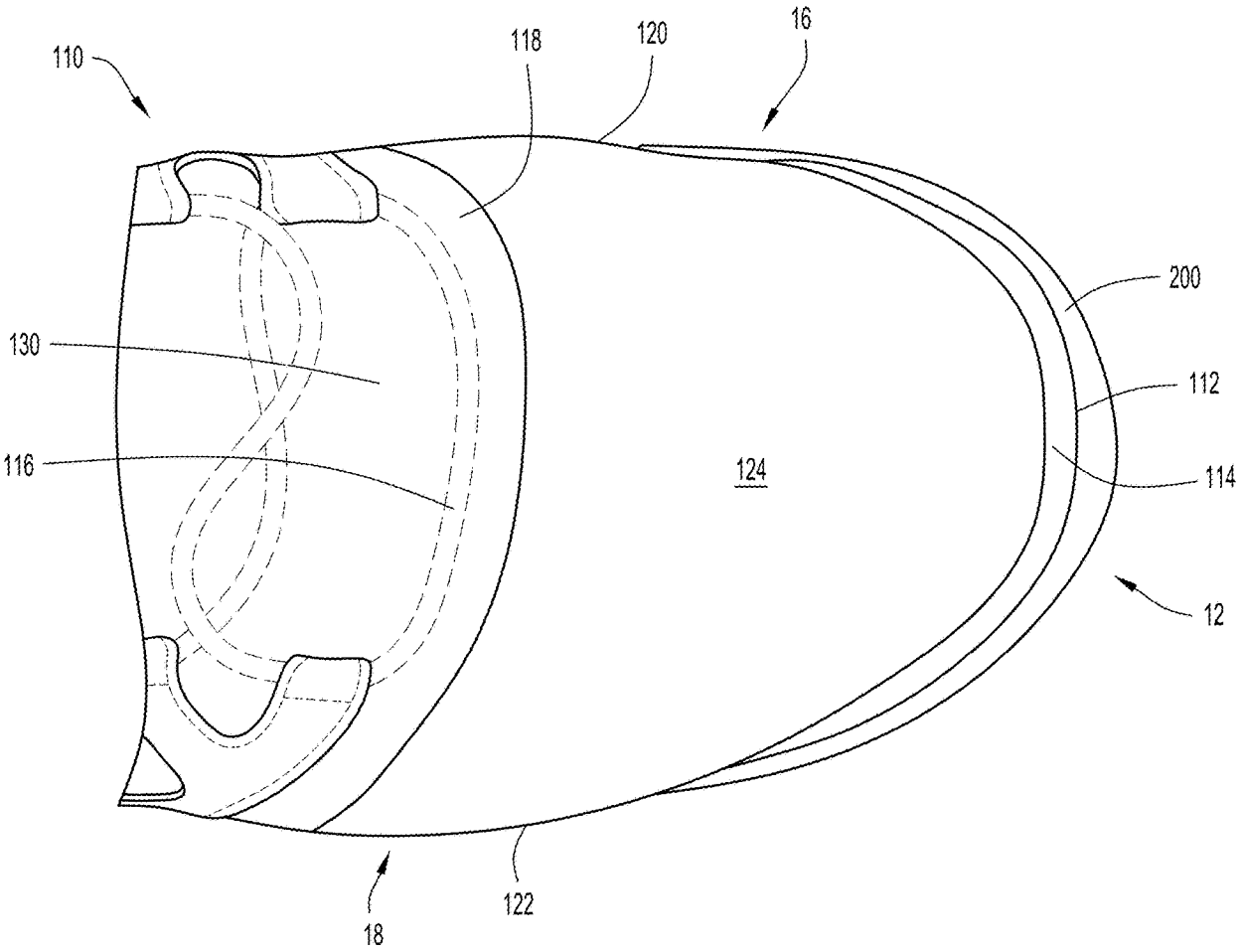
FIG. 2B illustrates a top view of the forefoot region of the embodiment of the article of footwear illustrated in FIG. 1.
Figure 2C:
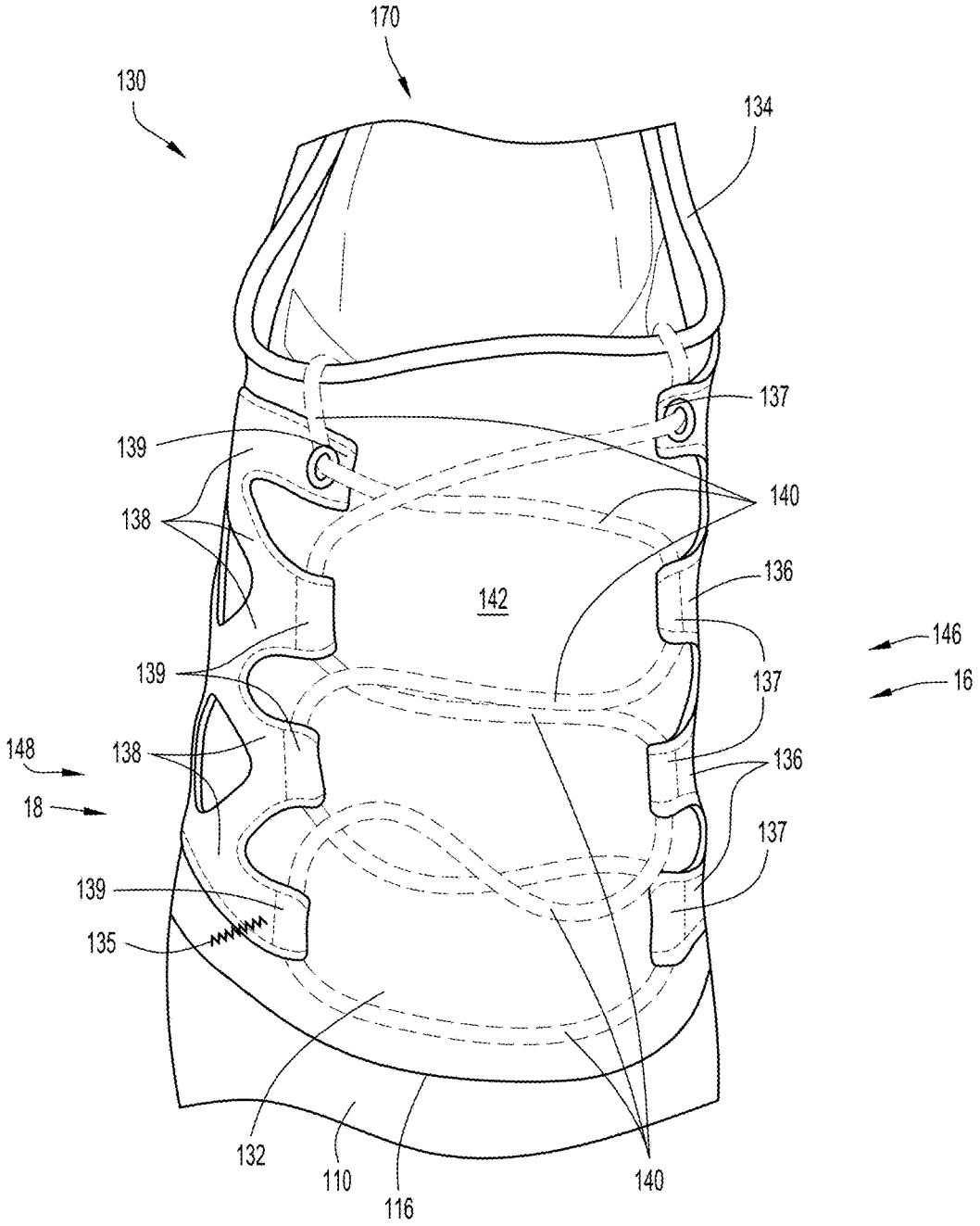
FIG. 2C illustrates a top view of the middle region of the embodiment of the article of footwear illustrated in FIG. 1.
Figure 2D:
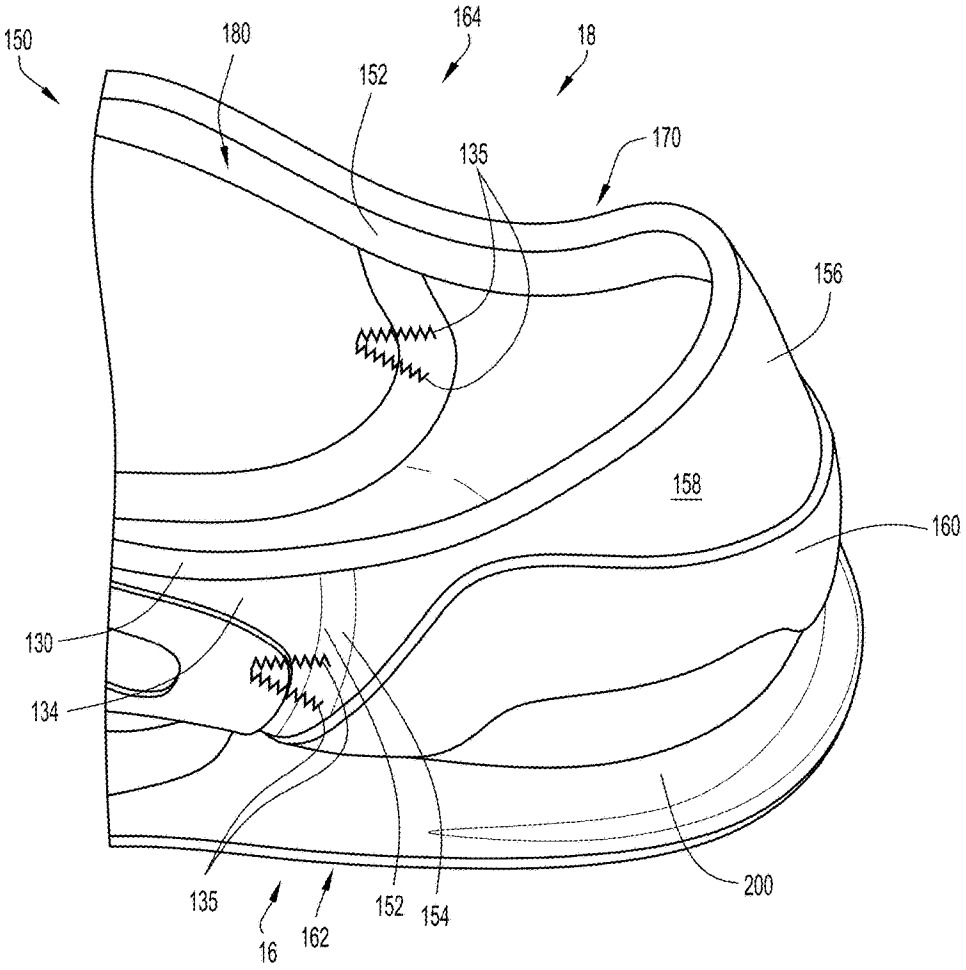
FIG. 2D illustrates a perspective view of the heel region of the embodiment of the article of footwear illustrated in FIG. 1.
Figure 2E:
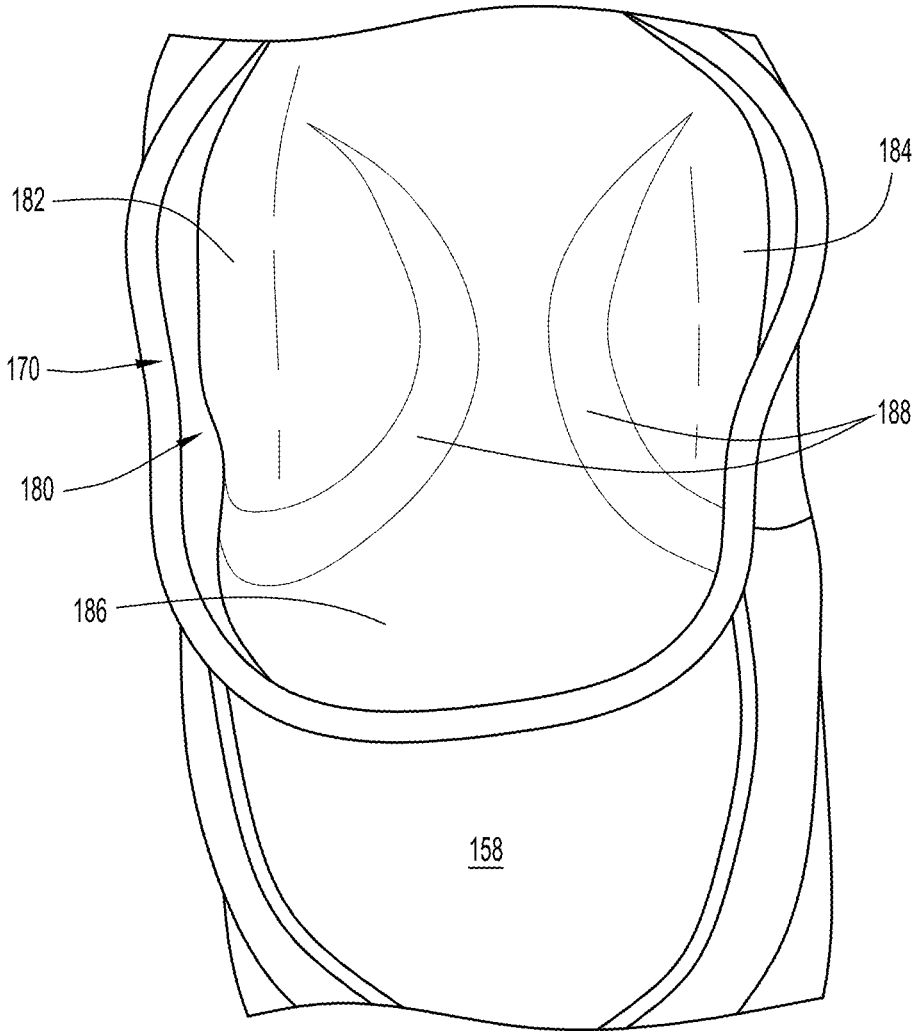
FIG. 2E illustrates a rear view of the inner cavity of the embodiment of the article of footwear illustrated in FIG. 1.
Figure 3:
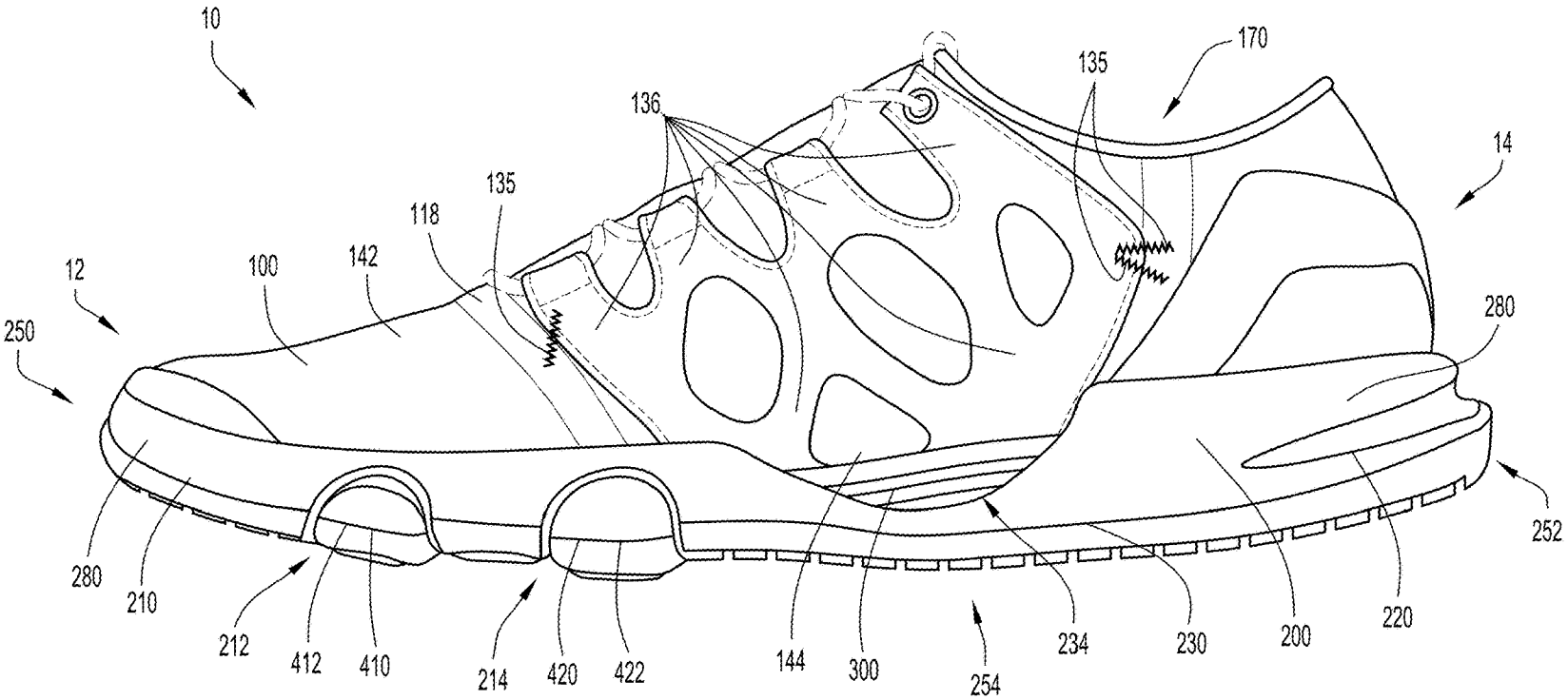
FIG. 3 illustrates a side view of the medial side of the embodiment of the article of footwear illustrated in FIG. 1.
Figure 4:
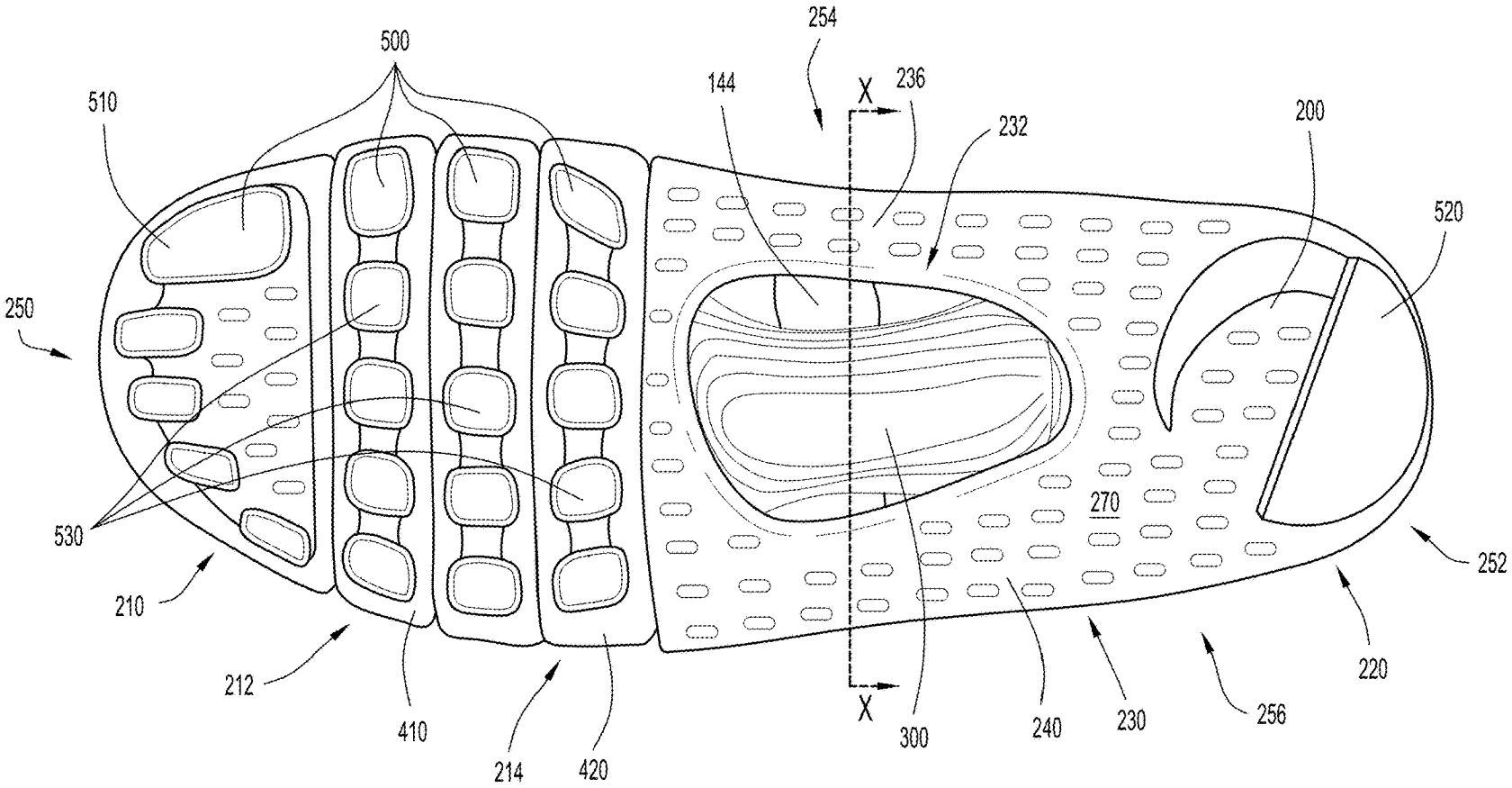
FIG. 4 illustrates a bottom view of the embodiment of the article of footwear illustrated in FIG. 1.

Turning to FIGS. 1 and 3, the first embodiment of the article of footwear 10 includes a forefoot end 12, a heel end 14, a medial side 16, and a lateral side 18. The first embodiment of the article of footwear 10 contains an upper 100, a midsole portion 200, an arch support member 300, a pair of flexible members 400, and an outsole 500 (illustrated in FIG. 4). The upper 100 is disposed on and coupled to the top of the midsole portion 200. The flexible members 400 are coupled to the bottom of the midsole 200, while the arch support member 300 is disposed on the upper 100 and extends between the midsole 200 and the upper 100. The outsole 500 is disposed on the bottom of the midsole 200 and the flexible members 400, as illustrated in FIG. 4. While the first embodiment 10 depicted in the figures (including FIGS. 1, 2A, 2B, 2C, 2D, 2E, 3-6, 7A, 7B, 8, and 9B) show an article of footwear configured for a right foot, it is noted that the same or similar features can also be provided for an article of footwear configured for a left foot (where such features of the left footed article of footwear are reflection or "mirror image" symmetrical in relation to the right footed article of footwear, e.g., the first embodiment 10 depicted in FIGS. 1, 2A, 2B, 2C, 2D, 2E, 3-6, 7A, 7B, 8, and 9B).

As illustrated in FIG. 2A, the upper 100 includes a forefoot region 110, a heel region 150, and a middle region or arch region 130 that is disposed between the forefoot region 110 and the heel region 150. The upper 100 may be constructed from various materials that are configured to conform and contour to a foot that is placed within the article of footwear 10. In some embodiments, various materials may be used to construct the upper 100, including, but not limited to, leather, synthetic leather, rubber, textile fabrics (e.g., breathable fabrics, mesh fabrics, synthetic fabrics), etc. One material used for the upper 100 may be configured to have a high degree of stretchability and compressibility, while another material used on the upper 100 may have a lower degree of stretchability and compressibility. The materials used on the upper 100 may be generally lightweight and flexible, and may be configured to provide comfort to the user and provide other desirable features. The materials used on the upper 100 may be configured to have desirable aesthetics and functional features that incorporate durability, flexibility, air permeability and/or other types of desirable properties to the upper 100.

As illustrated in FIG. 2B, the forefoot region 110 of the upper 100 includes a front end 112, a rear end 116, a medial side 120, and a lateral side 122. The front end 112 of the forefoot region 110 of the upper 100 is disposed at the forefoot end 12 of the article of footwear 10. Furthermore, the medial side 120 of the forefoot region 110 of the upper 100 is disposed on the medial side 16 of the article of footwear 10, while the lateral side 122 of the forefoot region 110 of the upper 100 is disposed on the lateral side 18 of the article of footwear 10. As illustrated in FIG. 2B, the rear end 116 of the forefoot region 110 is coupled to the middle region 130 of the upper 100. The connection of the forefoot region 110 to the middle region 130 may be secured via seam tape 118. Other forms of fastening means may be used to couple the forefoot region 110 to the middle region 130, including, but not limited to, glue, stitching, hemming, etc. In other embodiments, the forefoot region 110 and the middle region 130 may be formed from the same fabric or material, thus, making the coupling of the middle region 130 to the forefoot region 110 seamless or nonexistent.

In addition, the forefoot region 110 includes an outer surface 124. The outer surface 124 of the forefoot region 110 may serve as a barrier of the article of footwear 10 to protect the toes of the user from debris and to hold the toes within the interior cavity 180 (illustrated in FIG. 2E) of the first embodiment of the article of footwear 10. The forefoot region 110 further includes a forefoot guard or reinforcement member 114 that spans along the front end 112 from the medial side 120 to the lateral side 122, and is positioned proximate to the coupling of the front end 112 of the forefoot region 110 to the midsole 200. The forefoot guard 114 may protect the front end 112 of the forefoot region 110 and may aide in shaping the curvature of the front end 112 of the forefoot region 110. The forefoot guard 114 may be constructed of a thermoplastic polyurethane (TPU) or another similar thermoplastic with similar properties.

Turning to FIG. 2C, the middle region 130 of the upper 100 contains a front end 132, a rear end 134, a medial side 146, a lateral side 148, and a top surface 142. The upper 100 also includes a bottom surface 144, which is illustrated in FIGS. 3, 4, 7A, 7B, and 8. The medial side 146 of the middle region 130 of the upper 100 is disposed on the medial side 16 of the article of footwear 10, while the lateral side 148 of the middle region 130 of the upper 100 is disposed on the lateral side 18 of the article of footwear 10. The front end 132 of the middle region 130 is coupled to the rear end 116 of the forefoot region 110 via the seam tape 118. The rear end 134 of the middle region 130 is positioned proximate to the opening 170 to the interior cavity 180 of the article of footwear 10, as illustrated in FIGS. 2C, 2D, and 2E.

As further illustrated in FIG. 2C, on the medial side 146 of the middle region 130 of the upper 100 is disposed a set of medial straps 136. Disposed on the lateral side 148 of the middle region 130 of the upper 100 is a set of lateral straps 138. As best illustrated in FIGS. 2D and 3, the medial straps 136 may be secured to the medial side 146 of the middle region 130 of the upper 100 via connectors 135 proximate to the front end 132 and the rear end 134 of the middle region 130 of the upper 100. Similarly, as best illustrated in FIGS. 2C and 2D, the lateral straps 138 may be secured to the lateral side 148 of the middle region 130 of the upper 100 via connectors 135 proximate to the front end 132 and the rear end 134 of the middle region 130 of the upper 100. The connectors 135 may be sew lines that connect the straps 136, 138 to the middle region 130 of the upper 100.

The straps 136, 138 may be constructed from a non-stretchable material, such as leather, synthetic leather, plastic, etc. The straps 136, 138 may be constructed from a series of other materials that are non-stretchable and/or are resistant to substantial stretching. In the embodiment illustrated, the straps 136, 138 are constructed from three layers of materials that form an outer layer, a middle layer, and a backing layer. The outer layer may be constructed from a synthetic leather, the middle layer may be constructed from a textile, and the backing layer may be constructed from a thermoplastic polyurethane. Each of these layers may be bonded together via a hot melt film. In another example, the straps 136, 138 may be constructed from two layers of material, where the outer layer may be a non-stretchable material, such as leather, while the backing layer may be a heat settable polyester textile film. In this first embodiment, the polyester textile film may be capable of being contoured to a foot disposed in the article of footwear 10 and then anatomically molded around the foot when the polyester textile film is heated to a certain temperature. The polyester textile film may contain properties where the temperature required to heat set the film is low enough that it can be applied to the straps 136, 138 when a foot is placed within the article of footwear 10. In addition, the straps 136, 138 may not be heat set until the article of footwear 10 is worn by the end user, rather than being heat set during manufacture and production of the article of footwear 10. The polyester textile film is given dimensional stability once it is heat set.

The medial straps 136 include a first series of loops 137, while the lateral straps 138 include a second series of loops 139. The series of loops 137, 139 are disposed on the ends of the straps 136, 138. In some embodiments, the ends of the straps 136, 138 proximate to the opening 170 of the upper 100 may include a molded eyelet, rather than loops 137, 139. Furthermore, the middle region 130 of the upper 100 of the article of footwear 10 includes a string or lace 134 that is threaded through the loops 137, 139 of the straps 136, 138. The shoe string 134 may be pulled and tied tightly to bring the loops 137, 139 of the straps 136, 138 closer together over the top surface 142 of the upper 100. This cinches the upper 100 tightly around a foot placed within the upper.

Turning to FIG. 2D, the heel region 150 of the upper 100 includes a front end 152, a rear end 156, a medial side 162, and a lateral side 164. The medial side 162 of the heel region 150 of the upper 100 is disposed on the medial side 16 of the article of footwear 10, while the lateral side 164 of the heel region 150 of the upper 100 is disposed on the lateral side 18 of the article of footwear 10. The rear end 156 of the heel region 150 is disposed at the heel end 14 of the article of footwear 10. The front end 152 of the heel region 150 is coupled to the rear end 134 of the middle region 130 of the upper 100. As illustrated in FIG. 2D, seam tape 154 couples the rear end 134 of the middle region 130 to the front end 152 of the heel region 150. Other forms of fastening means may be used to couple the heel region 150 to the middle region 130, including, but not limited to, glue, stitching, hemming, etc. In other embodiments, the heel region 150 and the middle region 130 may be formed from the same fabric or material, thus, making the coupling of the middle region 130 to the heel region 150 seamless or nonexistent.

As illustrated in FIG. 2D, the heel region 150 further includes an outer surface 158 that extends substantially vertically from the top of the midsole 200. The outer surface 158 of the heel region 150 may serve as a barrier of the article of footwear 10 to protect the heel of the user from debris and to secure the heel of a foot to the article of footwear 10 and within the interior cavity 180 of the article of footwear 10. The heel region 150 further includes a heel guard/heel counter or reinforcement member 160 that spans along and around the outer surface 158 of the heel region 150 from the medial side 162 to the lateral side 164. The heel reinforcement member 160 provides structure to the shape and curvature of the heel region 150. The heel reinforcement member 160 may be constructed of a thermoplastic polyurethane (TPU) or another similar thermoplastic with similar properties.

As best illustrated in FIGS. 2D and 2E, the rear end 134 of the middle region 130 and the heel region 150 form the opening 170 to the interior cavity 180 of the upper 100 of the article of footwear 10. As illustrated in FIG. 2E, the upper 100 is configured to form an interior cavity 180 that includes a medial side 182, a lateral side 184, and a footbed 186. The medial side 182, lateral side 184, and footbed 186 extend from the rear end 156 of the heel region 150 of the upper 100 to the front end 112 of the forefoot region 110 of the upper 100. The medial side 182 and the lateral side 184 of the interior cavity 180 are coupled to the footbed 186 of the interior cavity via seam tape 188. Other forms of fastening means may be used to couple the medial side 182 and the lateral side 184 to the footbed 186, including, but not limited to, glue, stitching, hemming, etc.

As illustrated in FIG. 3, the upper 100 is disposed on the top of the midsole 200. The upper 100 may be disposed on and secured to the midsole 200. This may be accomplished by any means known, including, but not limited to, adhesives, co-molding, injection molding, stitching, welting, etc. According to the first embodiment of the article of footwear 10 illustrated in FIG. 3, the upper 100 may be secured to the midsole 200 by an adhesive.

As illustrated in FIGS. 3 and 4, the midsole 200 contains a front end 250, a rear end 252, a medial side 254, and a lateral side 256. The front end 250 of the midsole 200 is disposed proximate to the forefoot end 12 of the article of footwear 10, and the rear end 252 of the midsole 200 is disposed proximate to the heel end 14 of the article of footwear 10. Furthermore, the medial side 254 of the midsole is disposed proximate to the medial side 16 of the article of footwear 10, and the lateral side 256 of the midsole 200 is disposed proximate to the lateral side 18 of the article of footwear 10. The midsole 200 further includes a forefoot portion 210, a heel portion 220, and an arch portion 230. The forefoot portion 210 of the midsole 200 is disposed proximate to the forefoot end 12 of the article of footwear, while the heel portion 220 of the midsole 200 is disposed proximate to the heel end 14 of the article of footwear 10. The arch portion 230 is disposed between the forefoot portion 210 and the heel portion 220. The midsole 200 further includes a bottom surface 270, as illustrated in FIG. 4, that is configured to engage a support surface. While not illustrated, opposite of the bottom surface 270 is a top surface of the midsole 200, where the upper 100 is disposed on the top surface of the midsole 200. The bottom surface 270 of the midsole 200 is oriented on the surface of the midsole 200 that is opposite of the surface of the midsole 200 on which the upper 100 is disposed. The midsole 200 may be constructed from a thermoplastic or thermoset material, such as an ethylene-vinyl acetate (EVA) foam material, that is configured to compress on impact and provide cushion to the user's foot as the article of footwear 10 impacts a support surface. In the embodiment illustrated, the synthetic material of the midsole 200 may be constructed to have a durometer value (on a type C scale) of approximately 55 C with a variance of ±3 C. In other embodiments of the article of footwear 10, the midsole 200 may have durometer value that is greater or lesser than 55 C.

Figure 5:
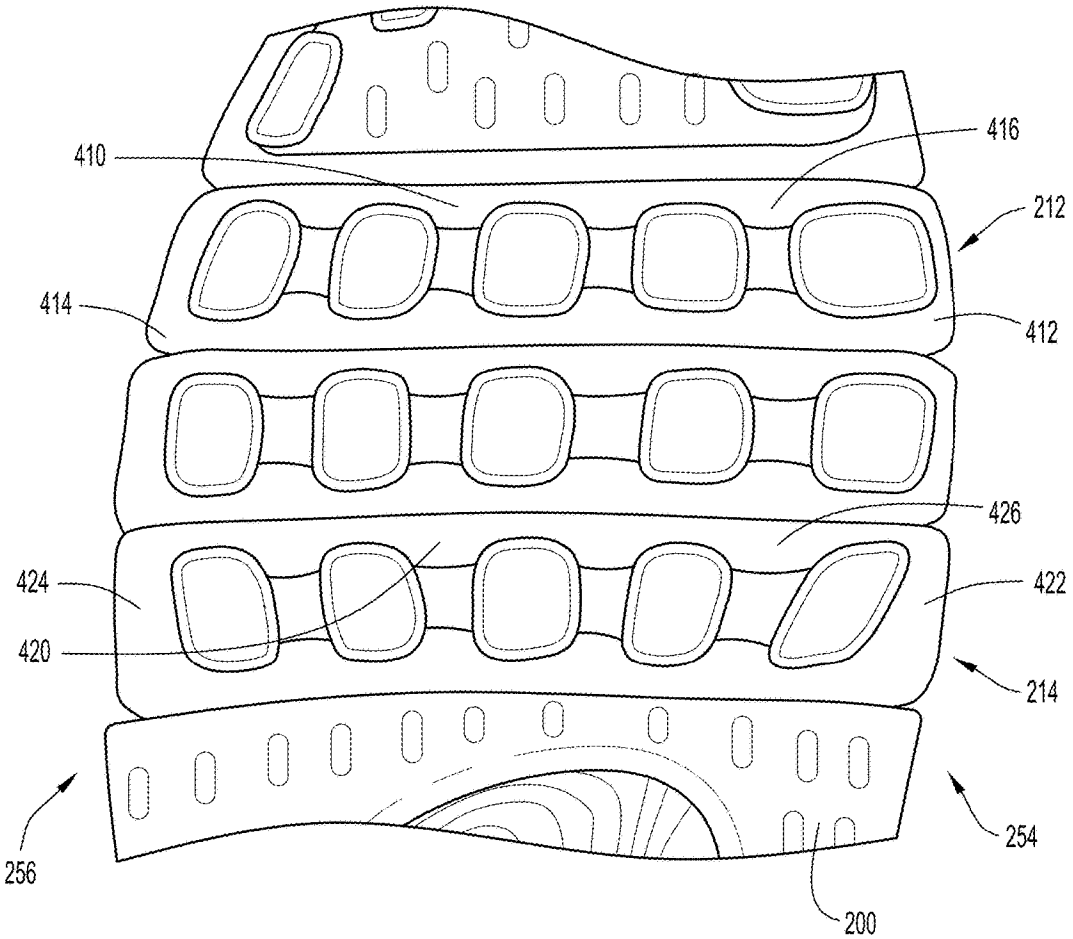
FIG. 5 illustrates a bottom view of the forefoot region of the embodiment of the article of footwear illustrated in FIG. 1.
Figure 6:
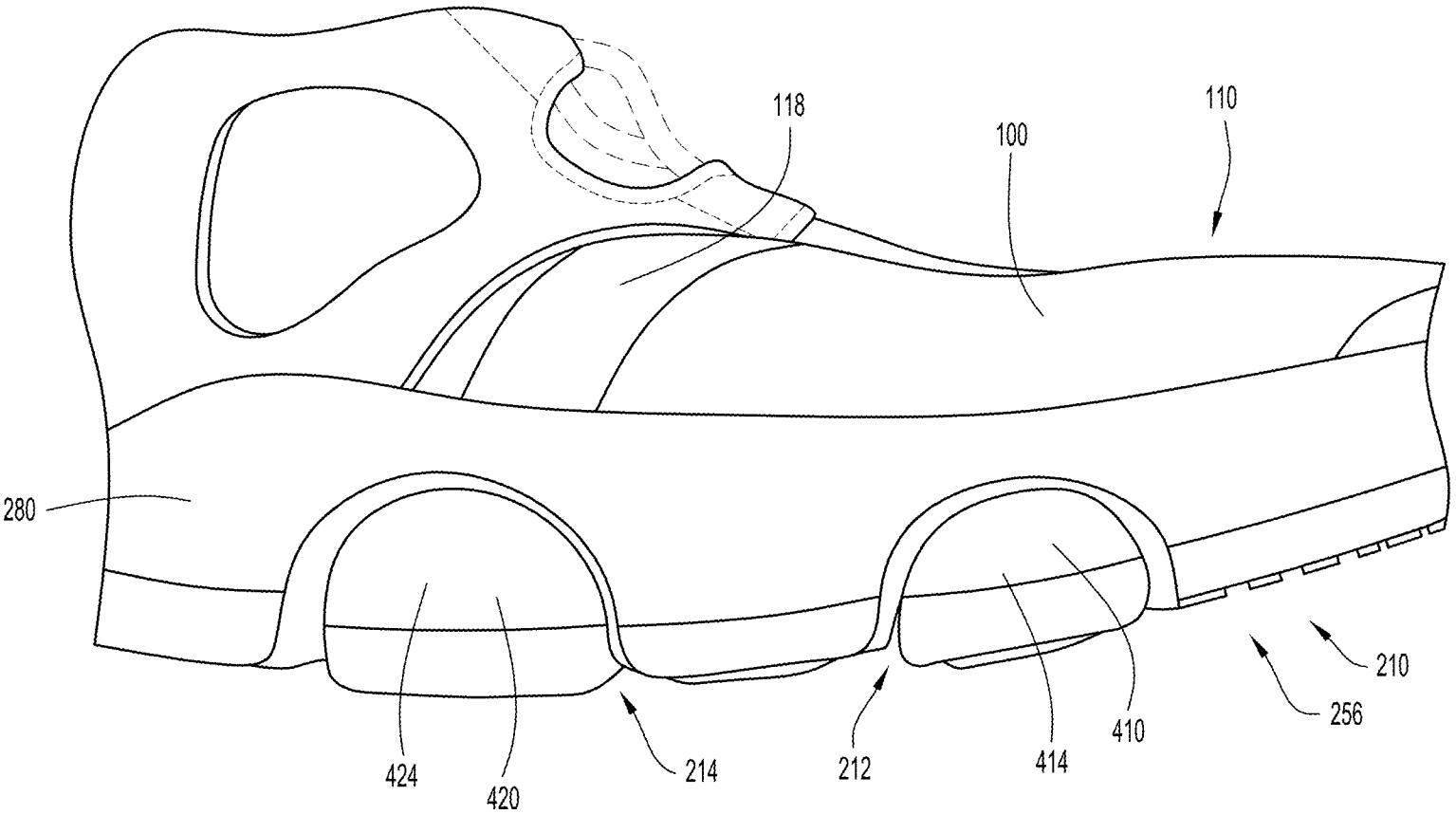
FIG. 6 illustrates a side view of the lateral side of the forefoot region of the embodiment of the article of footwear illustrated in FIG. 1.

As illustrated in FIGS. 3-6, the forefoot portion 210 of the midsole 200 includes a first depression 212 and a second depression 214. As illustrated, the first and second depressions 212, 214 are disposed on the bottom surface 270 of the midsole 200 in the forefoot portion 210, but are separated from one another. The cross-sectional shape of the first and second depressions 212, 214, as illustrated in FIGS. 3 and 6, may be semi-circular. The cross-sectional shape of the first and second depressions 212, 214 are not limited to a semi-circular shape. In other embodiments, the cross-sectional shape of the first and second depressions 212, 214 may be of a different shape, such as a square, a triangle, etc. As illustrated in FIGS. 4 and 5, the first and second depressions 212, 214 extend from the medial side 254 of the midsole 200 to the lateral side 256 of the midsole 200.

Disposed within the first and second depressions 212, 214 are flexible members 400. The flexible members 400 are made up of a first flexible member 410 and a second flexible member 420. Disposed within the first depression 212 is the first flexible member 410, while disposed within the second depression 214 is the second flexible member 420. The flexible members 410, 420 each contain a cross-sectional shape that is substantially similar to the cross-sectional shape of the first and second depressions 212, 214, respectively. Thus, in the embodiment illustrated in FIGS. 3-6, the first and second flexible members 410, 420 have a cross-sectional shape that is semi-circular.

As best illustrated in FIG. 5, the first flexible member 410 includes a medial end 412 and a lateral end 414. The medial end 412 is disposed proximate to, and aligned with, the medial side 254 of the forefoot portion 210 of the midsole 200, while the lateral end 414 is disposed proximate to, and aligned with, the lateral side 256 of the forefoot portion 210 of the midsole 200. Thus, the first flexible member 410 extends across the midsole 200 from the medial side 254 to the lateral side 256. The first flexible member 410 includes a bottom surface 416 that, when the first flexible member 410 is positioned within the first depression 212 of the forefoot portion 210 of the midsole, lies substantially even and coplanar or flush with the bottom surface 270 of the midsole 200. Similarly, the second flexible member 420 includes a medial end 422 and a lateral end 424. The medial end 422 is disposed proximate to, and aligned with, the medial side 254 of the forefoot portion 210 of the midsole 200, while the lateral end 424 is disposed proximate to, and aligned with, the lateral side 256 of the forefoot portion 210 of the midsole 200. Thus, the second flexible member 420 extends across the midsole 200 from the medial side 254 to the lateral side 256. The second flexible member 420 also includes a bottom surface 426 that, when the second flexible member 420 is positioned within the second depression 214 of the forefoot portion 210 of the midsole 200, lies substantially even and coplanar or flush with the bottom surface 270 of the midsole 200.

As best illustrated in FIGS. 3 and 6, the first depression 212 of the forefoot portion 210 and the first flexible member 410 are disposed closer to the front end 250 of the midsole 200 than the second depression 214 of the forefoot portion 210 and the second flexible member 420. The first and second depressions 212, 214 and the first and second flexible members 410, 420 are disposed on the midsole 200 proximate to the location where the ball of the user's foot would be located when placed within the article of footwear 10. In other words, the first and second depressions 212, 214 and the first and second flexible members 410, 420 are disposed on the midsole 200 proximate to where the metatarsal bones meet the phalanx bones of the foot of the user of the article of footwear 10.

In the embodiment illustrated, the first and second flexible members 410, 420 may be constructed from a thermoplastic or thermoset material, such as an ethylene-vinyl acetate (EVA) foam material, that is configured to compress on impact and provide cushion to the user's foot as the article of footwear 10 impacts a support surface. In the embodiment illustrated, the synthetic material of the first and second members 410, 420 may be constructed to have a durometer value that is less than that of the midsole 200, where the first and second members 410, 420 can have a durometer value of approximately 45 C with a variance of ±3 C. As stated previously, in the embodiment illustrated, the midsole 200 may be constructed to have a durometer value of approximately 55 C with a variance of ±3 C. Thus, the first and second flexible members 410, 420 provide additional cushioning and impact resistance to the foot in comparison with the midsole 200. Furthermore, the first and second flexible members 410, 420 may be disposed on the midsole 200 proximate to where the metatarsal bones meet the phalanx bones because that area of the foot receives a large amount of impact when a person is running. In other embodiments of the article of footwear 10, the first and second flexible members 410, 420 may have durometer value that is greater or lesser than 45 C.

The first and second flexible members 410, 420 may be disposed within the first and second depressions 210, 220 of the midsole 200 by co-molding the flexible members 410, 420 with the midsole 200. In other embodiments, the first and second flexible members 410, 420 may be configured to form a snap fit or friction fit with the first and second depressions 210, 220. This would enable the first and second flexible members 410, 420 to be removed for cleaning, or swapped with other flexible members that provide different levels of cushioning and impact resistance. In even another embodiment, the first and second flexible members 410, 420 may be secured in the first and second depressions 210, 220 via an adhesive.

Further illustrated in FIG. 4 is the outsole 500 of the first embodiment of the article of footwear 10. The outsole 500 may be comprised of three regions, the forefoot region 510, the heel region 520, and the ball of the foot region 530. The forefoot region 510 of the outsole 500 is disposed on the bottom surface 270 of the midsole 200 proximate to the forefoot end 250 of the midsole 200. The forefoot region 510 may be disposed proximate to the location of the toes of the foot placed within the article of footwear 10. As illustrated, the forefoot region 510 may be shaped to substantially follow the contours of the front end 250 of the midsole 200. However, in other embodiments, the forefoot region 510 may be formed in any shape. The heel region 520 of the outsole 500 may be disposed on the bottom surface 270 of the midsole 200 proximate to the heel end 252 of the midsole 200. As illustrated in FIG. 4, the heel region 520 of the outsole 500 is semi-circular in shape. However, in other embodiments, the heel region 520 may be formed in any shape.

Finally, the ball of the foot region 530 of the outsole 500 is disposed between the forefoot region 510 of the outsole 500 and the arch portion 230 of the midsole 200. The ball of the foot region 530 is located proximate to the ball of the foot of a user wearing the article of footwear 10. As illustrated in FIG. 4, the ball of the foot region 530 of the outsole 500 is configured as three elongated sections that extend from the medial side 254 of the midsole 200 to the lateral side 256 of the midsole 200. One section of the ball region 530 is disposed on the bottom surface 416 of the first flexible member 410, while another section of the ball of the foot region 530 is disposed on the bottom surface 426 of the second flexible member 420. Finally, the last section of the ball of the foot region 530 of the outsole 500 is disposed on the midsole 200 between the first depression 212 and the second depression 214. Thus, the last section of the ball of the foot region 530 is disposed on the midsole 200 between the first flexible member 410 and the second flexible member 420.

The outsole 500 may be constructed from a material that is durable and contains a durometer value greater than the midsole 200. The regions of the outsole 500 may be positioned on the midsole 200 at locations that receive the most wear on the bottom surface 270 of the midsole 200. In another embodiment, the outsole 500 may be configured to cover the entire bottom surface 270 of the midsole 200. The outsole 500 may be disposed within the bottom surface 270 of the midsole 200, the bottom surface 416 of the first flexible member 410, and the bottom surface 426 of the second flexible member 420 so that the outsole 500 is flush with each of these bottom surfaces 270, 416, 426. However, in other embodiments, the outsole 500 may protrude from these bottom surfaces 270, 416, 426 to prevent the bottom surfaces 270, 416, 426 from contacting the support surface regularly during use, which would cause their bottom surfaces 270, 416, 426 to be worn down more quickly.

Figure 7A:
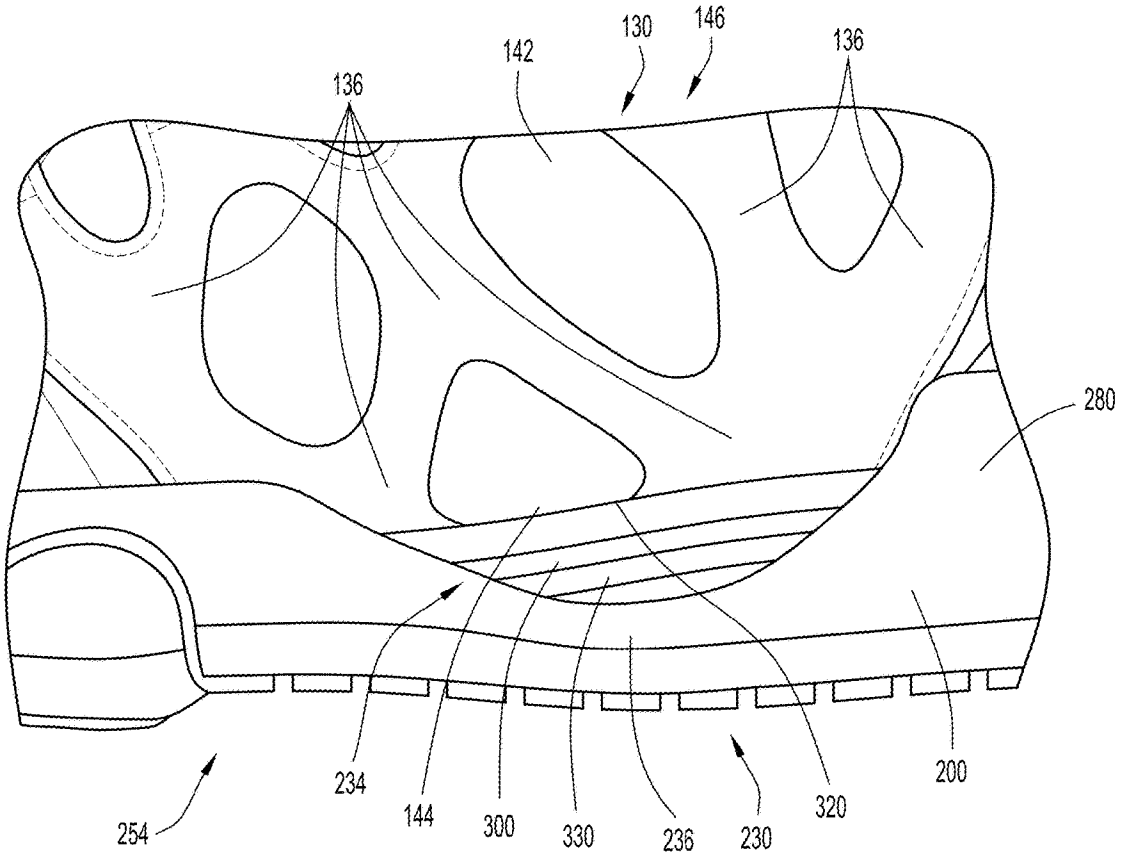
FIG. 7A illustrates a side view of the medial side of the middle region of the embodiment of the article of footwear illustrated in FIG. 1.
Figure 7B:
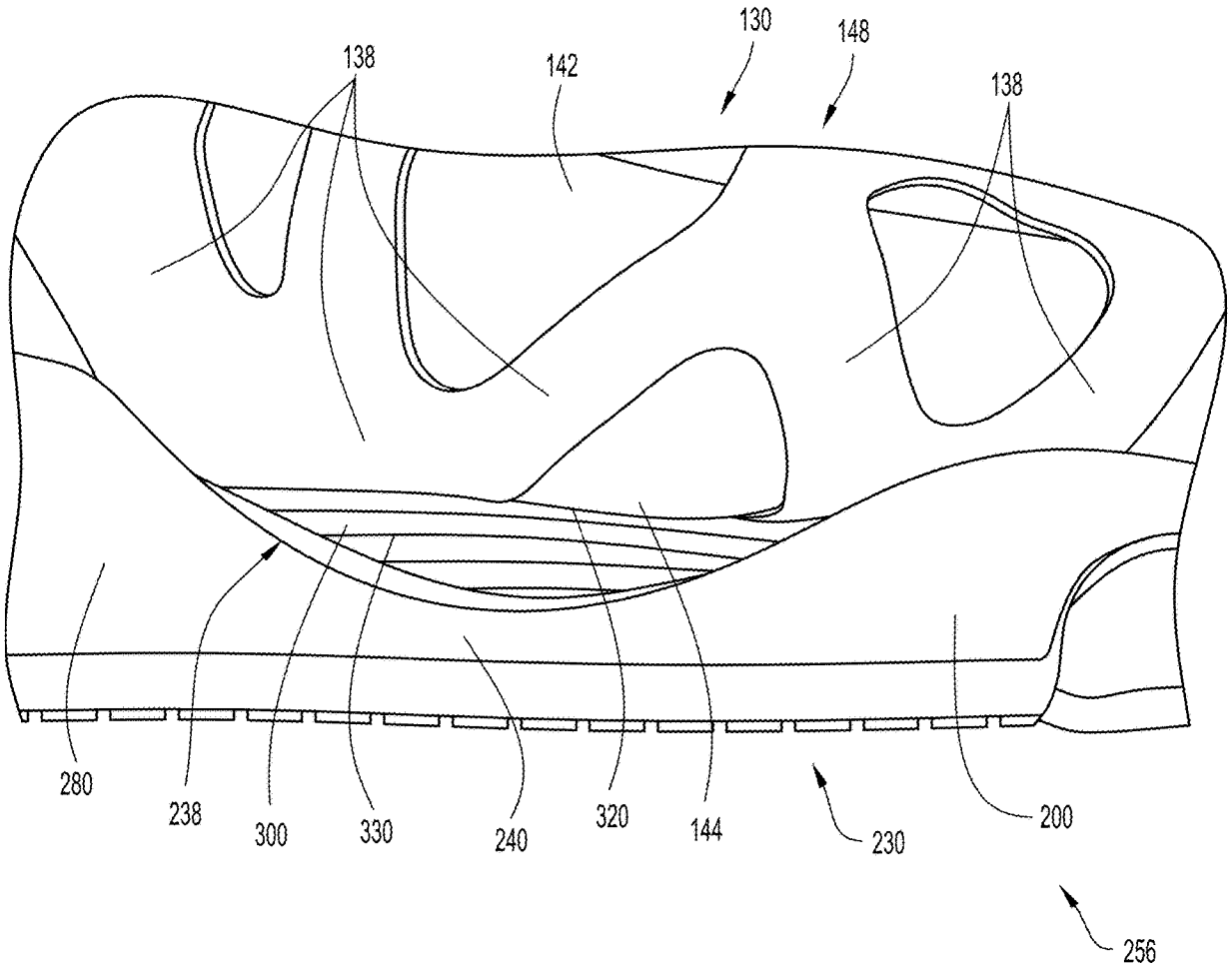
FIG. 7B illustrates a side view of the lateral side of the middle region of the embodiment of the article of footwear illustrated in FIG. 1.

As illustrated in FIG. 3, the midsole 200 includes a sidewall 280 along the perimeter of the midsole 200. The sidewall 280 has a larger height at the heel portion 220 of the midsole 200 than the sidewall 280 at the forefoot portion 210 of the midsole 200. As illustrated in FIGS. 3 and 7A, the arch portion 230 at the medial side 254 of the midsole 200 includes a first recess 234, while, as illustrated in FIG. 7B, the arch portion 230 at the lateral side 256 of the midsole 200 includes a second recess 238. Thus, as illustrated in FIGS. 3, 7A, and 7B, the sidewall 280 of the midsole 200 at the arch portion 230 is shorter in height than the sidewall 280 at the heel portion 220 and at the forefoot portion 210.

Figure 8:
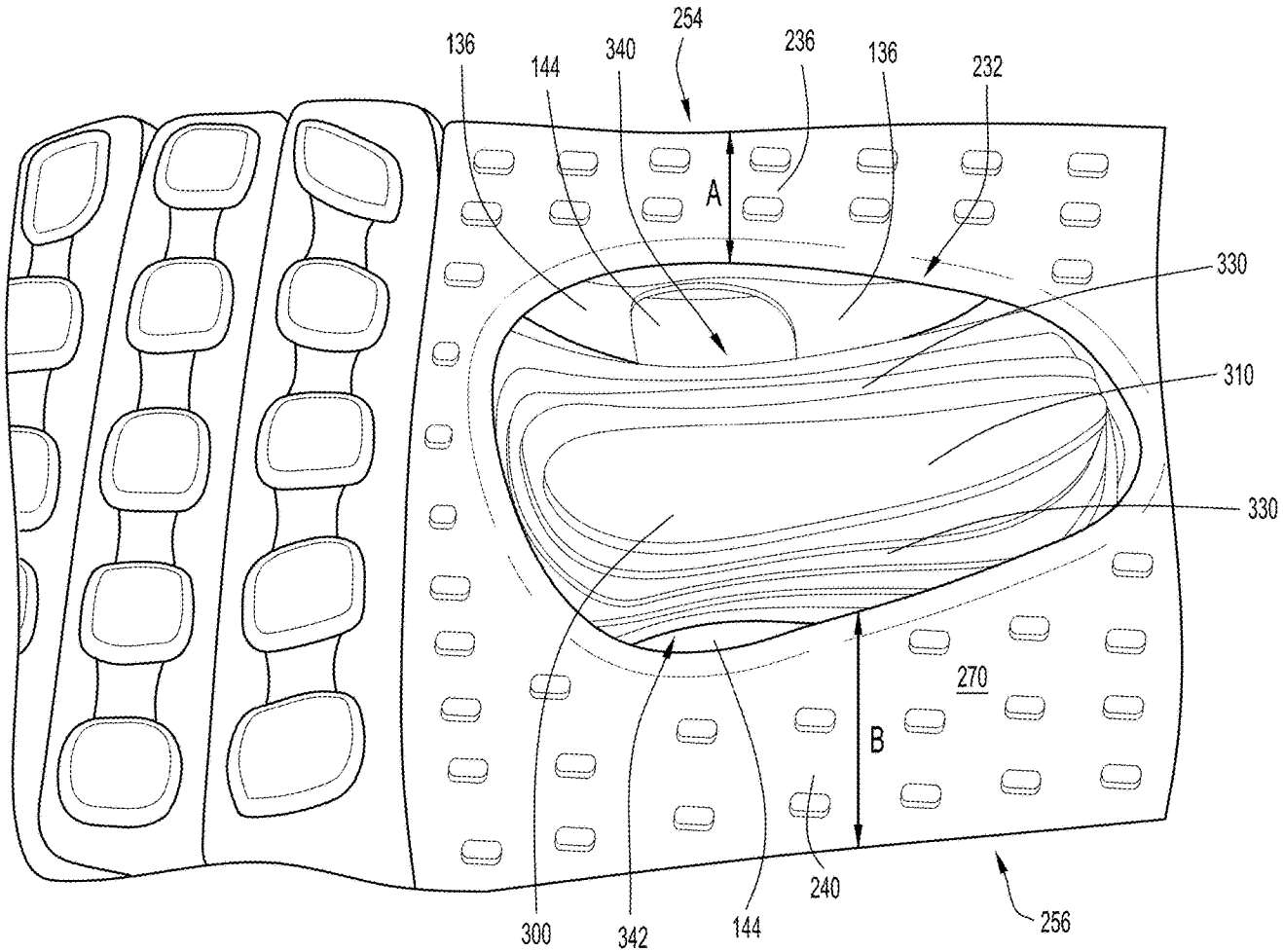
FIG. 8 illustrates a bottom view of the middle region of the embodiment of the article of footwear illustrated in FIG. 1.

Turning to FIGS. 3, 4, 7A, 7B, and 8, illustrated are various views of the arch portion 230 of the midsole 200. Disposed on the bottom surface 144 of the middle region 130 of the upper 100 is a support member 300. As best illustrated in FIGS. 4 and 8, the arch portion 230 of the midsole 200 further includes a central opening 232 disposed on the bottom surface 270 of the midsole 200. The central opening 232 is disposed on the bottom surface 270 of the midsole 200 between the medial and lateral sides 254, 256 of the midsole 200. The central opening 232, the first recess 234, and the second recess 238 are all interconnected and in fluid communication with one another, creating separation between the midsole 200 and the bottom surface 144 of upper 100 at a location proximate to the arch portion 230 of the midsole 200 and the middle region 130 of the upper 100. The central opening 232, the first recess 234, and the second recess 238 are interconnected to form one continuous cavity between the midsole 200 and the bottom surface 144 of the upper 100. As illustrated in FIGS. 3, 4, 7A, 7B, and 8, the bottom surface 144 of the upper 100 is exposed through the first recess 234, the second recess 238, and central opening 232.

As best illustrated in FIG. 8, because of the size and shape of the central opening 232, the arch portion 230 of the midsole 200 includes a first extension member 236 and a second extension member 240. The first extension member 236 is disposed proximate to the medial side 254 of the midsole 200 and is defined by the first recess 234 and the central opening 232. The second extension member 240 is disposed proximate to the lateral side 256 of the midsole 200 and is defined by the second recess 238 and the central opening 232. The first and second extension members 236, 238 extend substantially in the lengthwise direction of the article of footwear 10, from proximate the forefoot portion 210 of the midsole 200 to proximate to the heel portion 220 of the midsole 200.

In the embodiment illustrated in FIGS. 4 and 8, the first extension member 236 has a first width A, which is defined by the distance between the medial side 254 of the midsole 200 and the central opening 232. In addition, the second extension member 240 has a second width B, which is defined by the distance between the lateral side 256 of the midsole 200 and the central opening 232. As illustrated, the width B is greater than the width A. The width B of the second extension member 240 may be larger than the width A of the first extension member 236 because, as a user walks or runs, the weight of the user is transferred from the heel end 14 to the forefoot end 12 of the article of footwear 10 predominately along the lateral side 18 of the article of footwear 10. Thus, the second extension member 240, located on the lateral side 256 of the midsole 200 and the lateral side 18 of the article of footwear 10, provides additional support as the user's weight is transitioned from heel to forefoot. In addition, a wider second extension member 240 provides additional support on the lateral side 256 of the midsole 200 and the lateral side 18 of the article of footwear 10 when a user makes cutting movements while running or walking (i.e., sudden change in direction by pushing off of one foot creates an unusually large amount of lot of force on a lateral side of foot, etc.). In some embodiments, the widths of the first and second extensions members 236, 240 may be equal, or the width A of the first extension member 236 may be greater than the width B of the second extension member 240.

While the bottom surface 144 of the upper 100 is exposed proximate to the arch portion 230 of the midsole 200, a support member 300 is disposed on the bottom surface 144 of the upper 100 proximate to middle region 130 of the upper 100. Thus, the support member 300 is positioned proximate to the arch of a foot of a user wearing the article of footwear 10. The support member 300 is disposed on the bottom surface 144 of the upper 100 between the upper 100 and the midsole 200. The support member 300 includes a contact surface 310, a base 320, and sidewalls 330 that extend from the base 320 to the contact surface 310. The support member 300 further includes a medial side 340 and a lateral side 342. In the embodiment illustrated, base 320 of the support member 300 may be disposed on the bottom surface 144 of the upper 100 via an adhesive. The medial side 340 of the support member 300 is positioned proximate to the medial side 254 of the midsole 200, while the lateral side 342 of the support member 300 is positioned proximate to the lateral side 256 of the midsole 200. In other embodiments, the support member 300 may be co-molded onto the bottom surface 144 of the upper 100. In another embodiment, the support member 300 may be an extension of the middle region 130 of the upper 100.

Figure 9B:
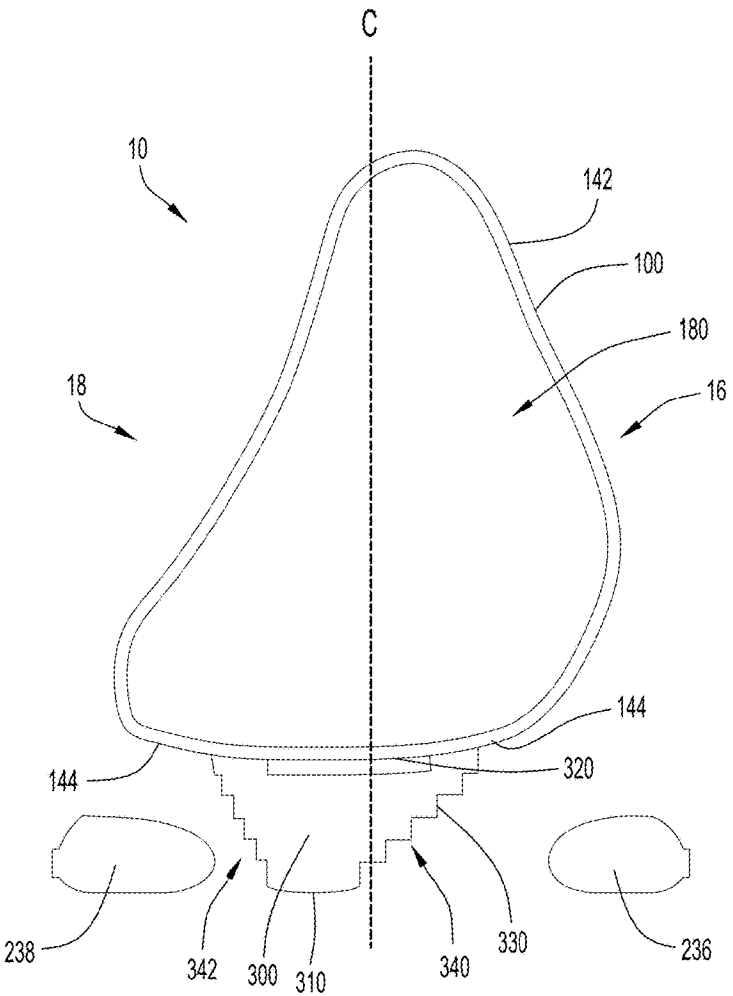
FIG. 9B illustrates a cross sectional view of the embodiment of the article of footwear illustrated in FIG. 1.

As best illustrated in FIG. 8 (and FIG. 9B), the base 320 of the support member 300 may be wider than the contact surface 310 of the support member 300. Furthermore, as illustrated in FIGS. 7A, 7B, and 8, the sidewalls 330 of the support member 300 taper from the wider width of the base 320 to the thinner width of the contact surface 310. The tapering sidewalls 330 may be smooth or may be a series of steps, like that illustrated in FIGS. 7A, 7B, and 8. By changing the widths of the contact surface 310 and the base 320, the degree at which the sidewalls 330 taper may vary. Varying the degree of the tapering of the sidewalls 330 may alter the compressible properties of the support member 300. As illustrated best in FIG. 8, the sidewall 330 on the medial side 340 of the support member 300 is tapered to a greater degree than the sidewall 330 on the lateral side 342 of the support member 300. This tapering of the sidewalls 330 of the support member 300 positions more structure of the support member 300 along the lateral side 342 of the support member 300 than the medial side 340 of the support member 300. As best illustrated in FIG. 9B, the article of footwear 10 has a center lengthwise plane C, and the support member 300 contains more structure on the lateral side 342 of the support member 300 than the medial side 340 of the support member 300. Thus, the contact surface 310 of the support member 300 is offset from the center lengthwise plane C of the support member 300 and is disposed closer to the lateral side 342 of the support member 300 than the medial side 240 of the support member 300.

As illustrated in FIGS. 4 and 8, the support member 300 is positioned on the bottom surface 144 of the upper 100 proximate to the central opening 232 of the arch portion 230 of the midsole 200. The support member 300 extends downwardly from the upper 100 at least partially into the central opening 232 of the arch portion 230 of the midsole 200. When a user places their weight on the article of footwear 10, the support member 300 may be forced through the central opening 232 of the arch portion 230 of the midsole 200 so that the contact surface 310 of the support member 300 contacts the support surface. Because the contact surface 310 of the support member 300 is offset and disposed closer to the lateral side 342 of the support member 300 than the medial side 240 of the support member 300, the support member 300 is configured to support more of the lateral side of a user's foot than the medial side of the user's foot.

In the embodiment illustrated, the support member 300 may be constructed from a thermoplastic or thermoset material, such as an ethylene-vinyl acetate (EVA) foam material, that is configured to compress on impact and provide cushion and support to the foot as the article of footwear 10 impacts a support surface. In the embodiment illustrated, the synthetic material of support member 300 may be constructed to have a durometer value of approximately 45 C with a variance of ±3 C. Thus, the support member 300 may be constructed from the same or similar material as that of the first and second flexible members 410, 420. As stated previously, in the embodiment illustrated, the midsole 200 may be constructed to have a durometer value of approximately 55 C with a variance of ±3 C. Thus, the support member 300 provides additional cushioning and impact resistance to the foot, and more specifically the arch of the foot, in comparison with the midsole 200. As previously explained, the support member 300 may be disposed proximate to the arch portion 230 of the midsole 200 and the middle region 130 of the upper 100, which is proximate to the arch of the foot. Thus, the support member 300 aids in supporting the portion of the foot containing the arch as the weight of the body is transitioned from the heel end 14 of the article of footwear 10 to the forefoot end 12 of the article of footwear 10 during walking and running motions. The support member 300 prevents the arch of the foot from collapsing and the foot from hyper-extending. In other embodiments of the article of footwear 10, the support member 300 may have a durometer value that is greater or lesser than 45 C.

Turning to FIGS. 7A and 7B, illustrated is the medial side 254 of the midsole 200 at the arch portion 230 and the lateral side 256 of the midsole 200 at the arch portion 230, respectively. As illustrated in FIG. 7A, the first recess 234 enables the bottom surface 144 of the middle region 130 of the upper 100 to be a continuation of the top surface 142 of the middle region 130 of the upper 100 along the medial side 146 of the middle region 130 of the upper 100. Similarly, as illustrated in FIG. 7B, the second recess 238 enables the bottom surface 144 of the middle region 130 of the upper 100 to be a continuation of the top surface 142 of the middle region 130 of the upper 100 along the lateral side 148 of the middle region 130 of the upper 100. Thus, the upper 100 at the middle region 130 is configured to continuously wrap around and encompasses the top, bottom, medial side, and lateral side of the arch of a foot.

As further illustrated in FIG. 7A, because of the first recess 234, the medial straps 136 may extend along the medial side 146 of the upper 100 from the top surface 142 to the bottom surface 144 so that the medial straps 136 are at least partially disposed along the bottom surface 144 of the upper 100. The medial straps 136 extend along the bottom surface 144 of the upper 100, where a portion of the medial straps 136 is positioned between the base 320 of the support member 300 and the bottom surface 144 of the upper 100. In addition, FIG. 7B illustrates that because of the second recess 238, the lateral straps 138 may extend along the lateral side 148 of the upper 100 from the top surface 142 to the bottom surface 144 so that the medial straps 136 are at least partially disposed along the bottom surface 144 of the upper 100. The lateral straps 138 extend along the bottom surface 144 of the upper 100, where a portion of the lateral straps 138 is positioned between the base 320 of the support member 300 and the bottom surface 144 of the upper 100. According to one embodiment, the ends of the medial strap 136 and the lateral strap 138 may be coupled together proximate to the bottom surface 144 of the upper 100, and may be coupled to the bottom surface 144 of the upper 100. In this embodiment, the straps also wrap continuously around the arch of the foot disposed within the upper 100. In another embodiment, the ends of the medial and lateral straps 136, 138 may be coupled to the bottom surface 144 of the upper 100 proximate to one another, but the medial and lateral straps 136, 138 are not coupled directly to one another.

As previously stated, because of the first and second recesses 234, 238 of the arch portion 230 of the midsole 200, the middle region 130 of the upper 100 is configured to wrap around the arch region of the user's foot to a greater degree than a conventional article of footwear. The material of the upper 100 combined with not being coupled to the midsole 200 proximate to the arch of the foot of the user enables the upper 100 to wrap around and contour to the arch of the user's foot. As the laces 140 (illustrated in FIG. 2C) are tightened, the loops 137 of the medial straps 136 and the loops 139 of the lateral straps 138 are pulled closer together. It then follows that, as the loops 137, 139 of the straps 136, 138 are pulled together, the middle region 130 of the upper 100 is pulled tightly against the arch of the foot of the user wearing the article of footwear 10, which causes the upper 100 to further contour to the arch of the foot as it is being cinched by the tightening of the laces 140 and the straps 136, 138. Thus, the middle region 130 of the upper 100 is configured to take the shape of the portion of the foot that is located within the middle region 130.

Figure 9A:
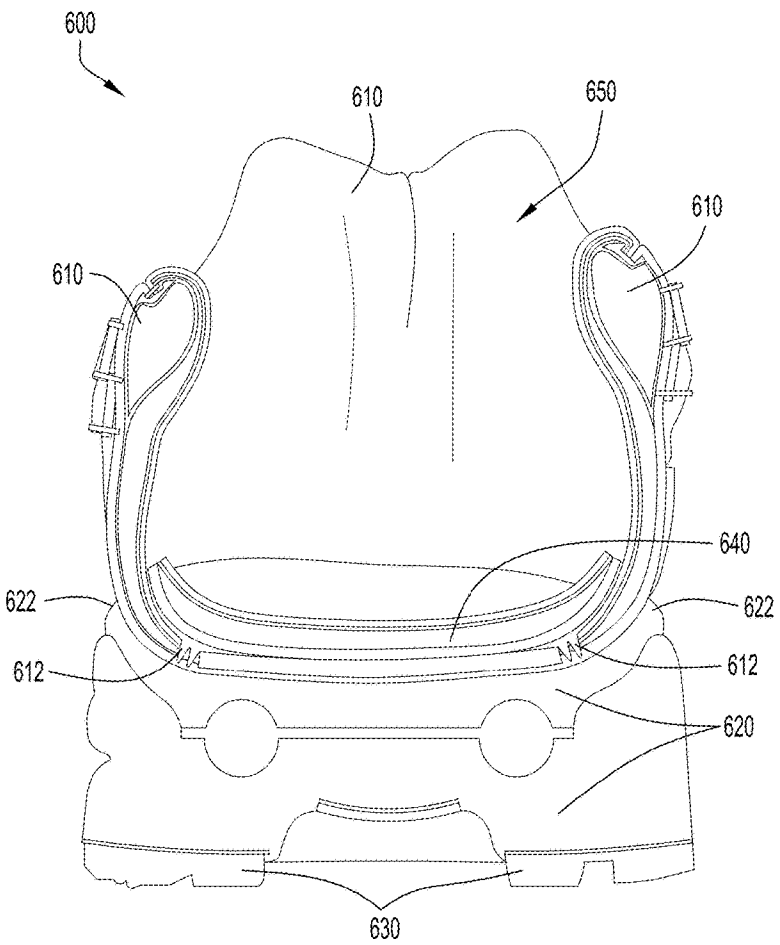
FIG. 9A illustrates a cross sectional view of a prior art version of an article of footwear.
Figure 10:
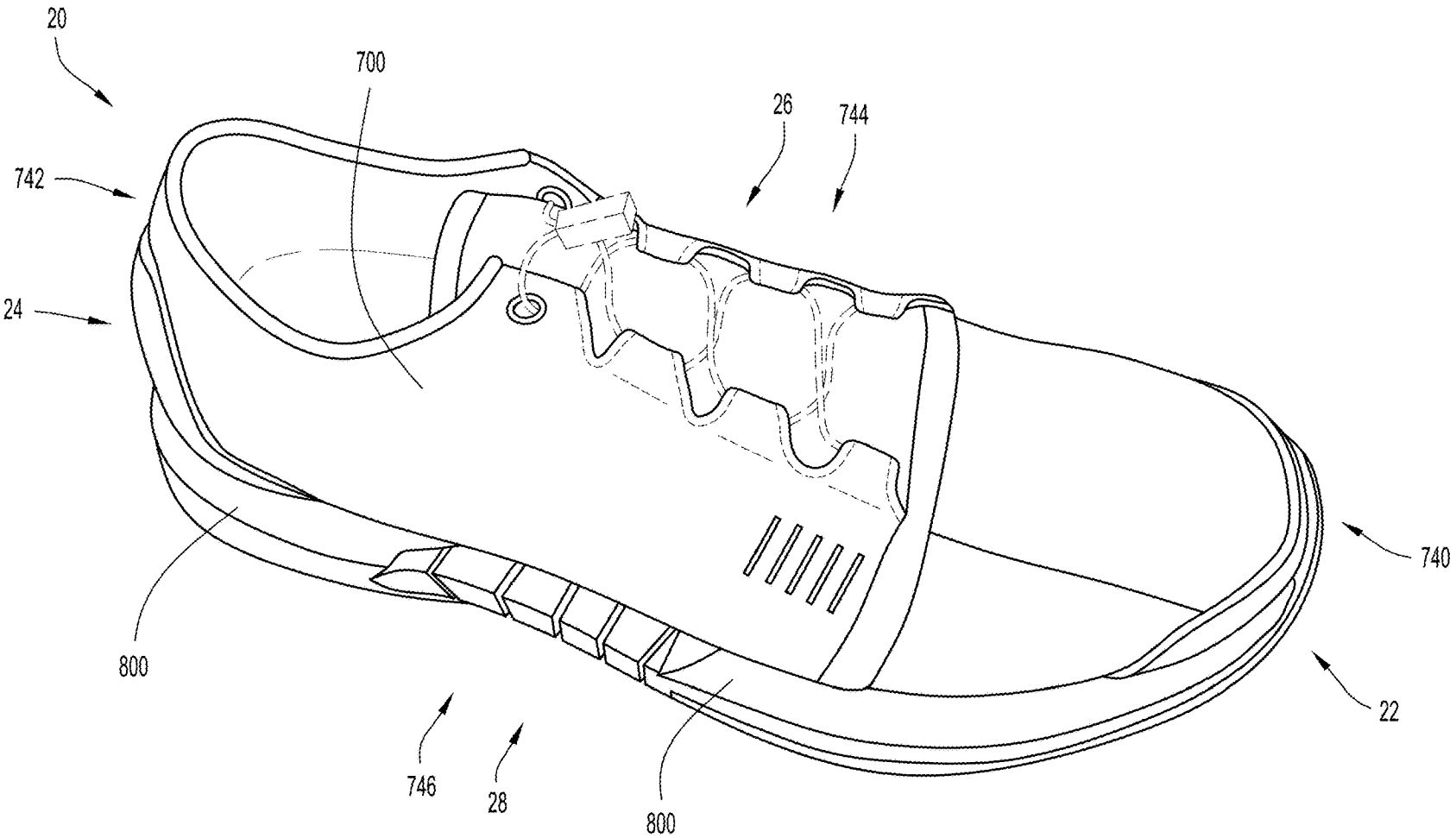
FIG. 10 illustrates a perspective view of another embodiment of an article of footwear according to the present invention.

Illustrated in FIG. 9A is a cross-sectional view of the arch region of a conventional article of footwear 600. In a conventional article of footwear 600, the upper 610 contains ends 612 that are coupled to the midsole 620 proximate to the upper edges 622 of the midsole 620. The upper 610 is not configured to wrap entirely around the arch of a foot placed within the article of footwear 600. The conventional article of footwear 600 may also include an insole 640 positioned within the interior 650 of conventional article of footwear 600. As illustrated, the insole 640 may be constructed from several layers of material configured to provide a cushion to the foot. The combination of the midsole 620 and the insole 640 are configured to provide the arch support of a conventional article of footwear 600. Because the upper 610 is coupled to the midsole 620 proximate the upper edges 622, and because the midsole 620 is often constructed from a material that is more rigid than the upper 610, tightening the laces of the conventional article of footwear 600 does not result in either the upper 610 or the midsole 620 to contour completely to the arch of the foot. Thus, conventional articles of footwear 600 must provide adequate arch support to users by the shape and layers of the insole 640 and/or the shape of the midsole 620. Because every user's foot, and more specifically, the arch of the foot, is different, the conventional article of footwear 600 may only properly support the arch of a foot of a limited number of users.

Conversely, as illustrated in FIG. 9B, the upper 100 is able to more easily conform to the arch of a user's foot than that of the conventional article of footwear 600. FIG. 9B illustrates a cross-sectional view of the first embodiment of the article of footwear 10 taken along line X-X of FIG. 4. As illustrated in FIG. 9B and previously described, the upper 100 of the article of footwear 10 defines an interior cavity 180 and includes a top surface 142 and a bottom surface 144 proximate to the arch of the foot. The support member 300 is disposed on the bottom 144 of the upper 100 at the base 320 of the supper member 300. As illustrated in FIG. 9B, a significant portion of the upper 100, especially when compared to the upper 610 of the conventional article of footwear 600, is configured to be contoured to the foot placed within the interior cavity 180 of the article of footwear 10. The bottom 144 of the upper 100 is only limited from contouring by the base 320 of the support member 300, which is much smaller in width than the entire midsole 620 of the conventional article of footwear 600.

As further illustrated in FIG. 9B, the sidewalls 330 of the support member 300 are tapered from the base 320 of the support member 300 towards the contact surface 310 of the support member 300, where the contact surface 310 of the support member 300 is offset from the central lengthwise plane C of the article of footwear 10. As previously explained, the sidewall 330 on the lateral side 342 of the support member 300 is substantially more vertically oriented than the sidewall 330 on the medial side 340 of the support member 300. As illustrated, the support member 300 is configured to provide support for the portion of the foot closer to the lateral side 18 of the article of footwear 10 than to the medial side 16 of the article of footwear 10. By providing less support along the medial side 340 of the support member 300, the article of footwear 10 allows the medial side of the arch of the foot to flex when running or walking with the article of footwear 10, but still remain supported by the upper 100. Traditional arch supports in the conventional articles of footwear 600 prevent the arch of the user's foot from flexing and strengthening. By propping the arch of the foot like that in conventional articles of footwear 10, the arch may become weaker and more susceptible to injury over time. However, by supporting the arch of the foot with the upper 100 of the article of footwear disclosed herein, the arch is still supported, but is able to flex, which results in a stronger arch that is less susceptible to injury.

As further illustrated in the comparison of FIGS. 9A and 9B, the article of footwear 10 disclosed herein contains less structure in the arch region of the article of footwear 10 than that of the arch region of the conventional article of footwear 600. The article of footwear 10 illustrated in FIG. 9B and disclosed herein illustrates that only the first and second extension members 236, 238 and the contact surface 310 of the support member 300 support the arch region of the foot on a support surface, while the conventional article of footwear 600 contains a large midsole 620 and outsole 630 to support the arch region of the foot on a support surface. Furthermore, the upper 100 of the article of footwear 10 illustrated in FIG. 9B is thinner and contains fewer layers than the upper 610 of the conventional article of footwear 600 illustrated in FIG. 9A. Finally, the conventional article of footwear 600 illustrated in FIG. 9A requires the use of an insole 640 that is constructed from multiple layers of material and adhesives to provide cushion and support to the arch region of the user's foot. The shape and fewer materials used to construct the article of footwear 10 illustrated in FIG. 9B enables the article of footwear 10 to be lighter and more flexible than the conventional article of footwear 600, while also providing superior arch support, as previously explained.

Figure 12A:
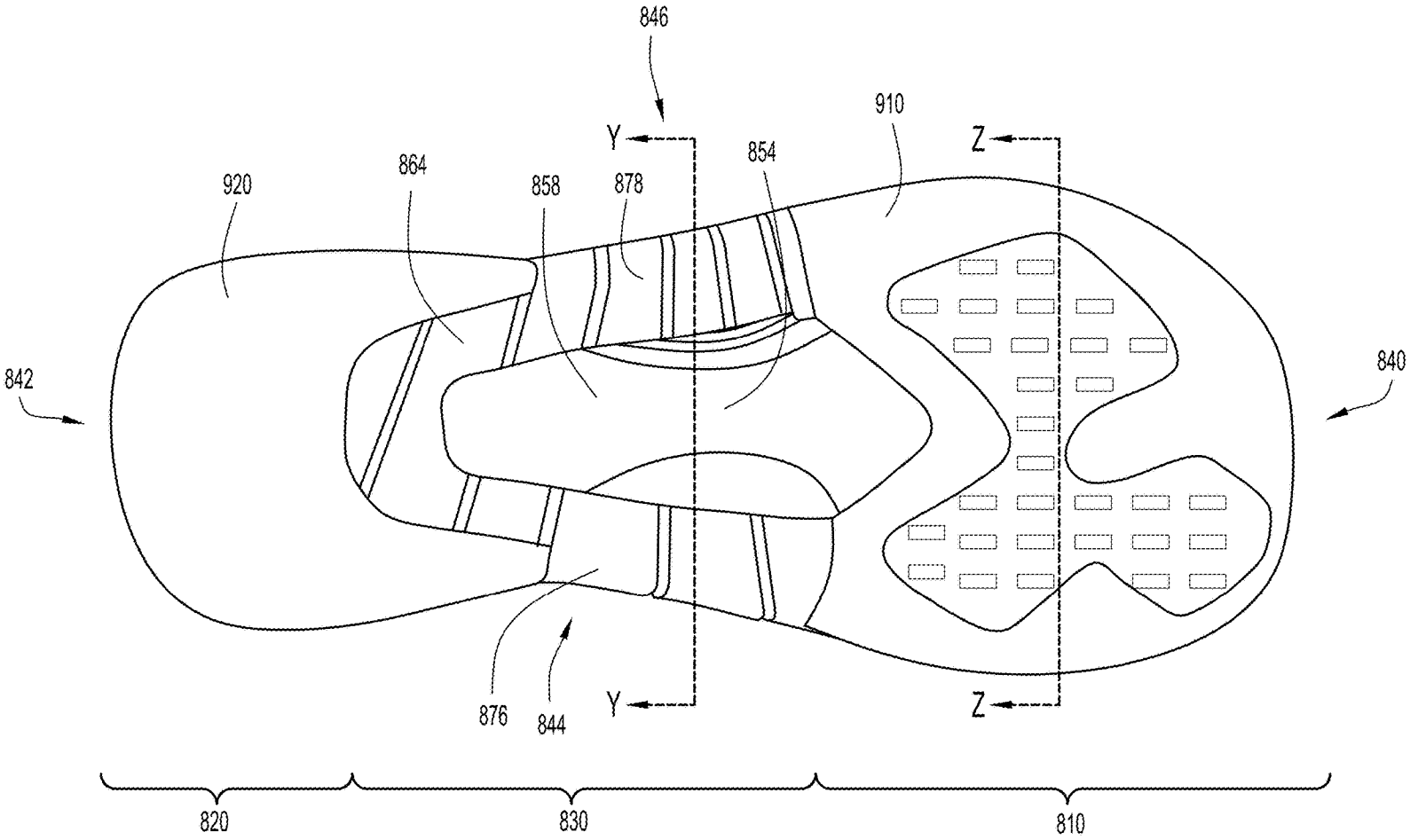
FIG. 12A illustrates a bottom view of the embodiment of the article of footwear illustrated in FIG. 10.
Figure 12B:
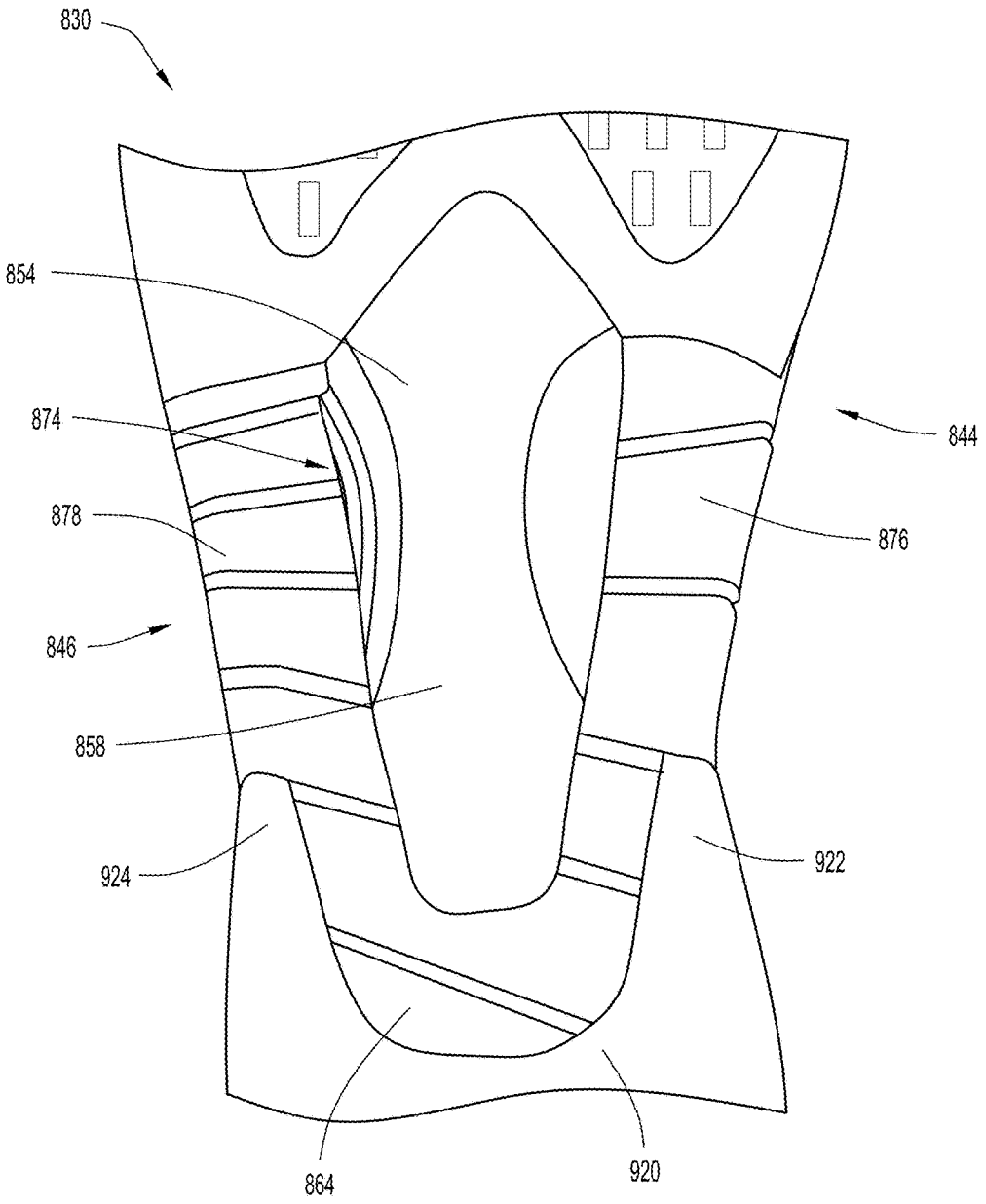
FIG. 12B illustrates a bottom view of the midfoot region of the embodiment of the article of footwear illustrated in FIG. 10.
Figure 13:
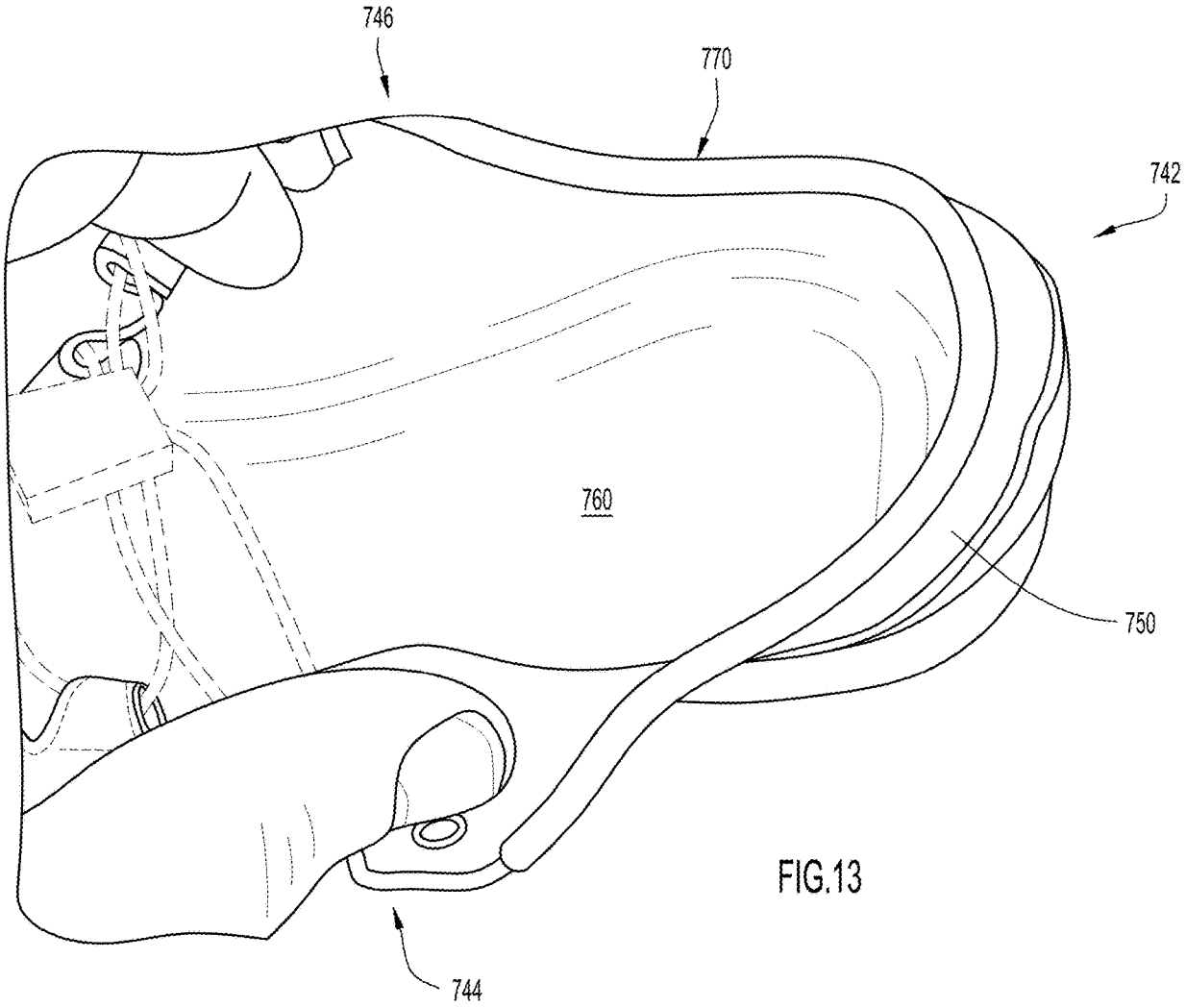
FIG. 13 illustrates an interior view of the upper of the embodiment of the article of footwear illustrated in FIG. 10.
Figure 14A:
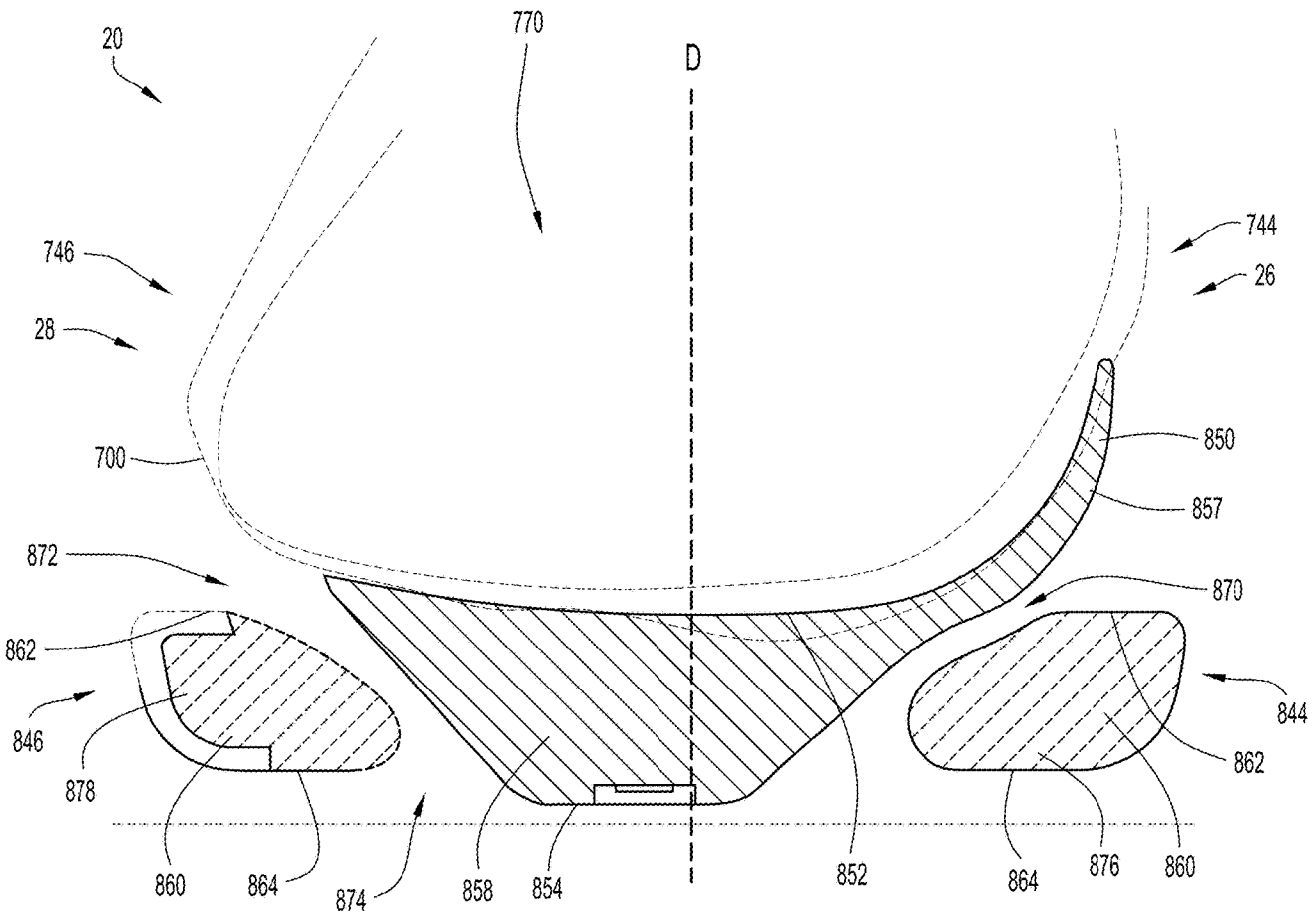
FIG. 14A illustrates a cross sectional view of the arch region of the embodiment of the article of footwear illustrated in FIG. 10.
Figure 14B:
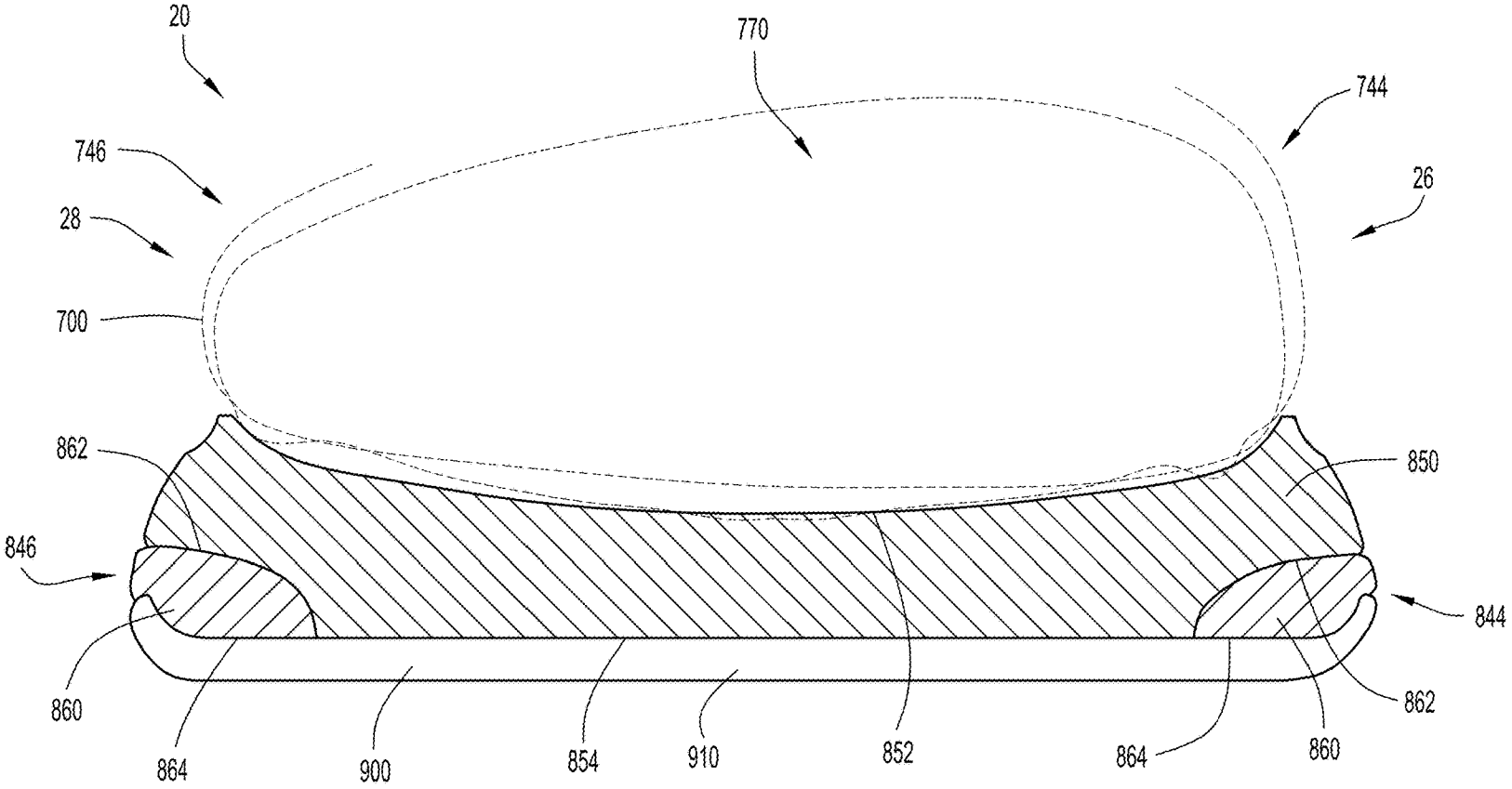
FIG. 14B illustrates a cross-sectional view of the forefoot region of the embodiment of the article of footwear illustrated in FIG. 10.

A second embodiment of the article of footwear is illustrated in FIGS. 10, 11A, 11B, 12A, 12B, 13, 14A, and 14B. FIG. 14A illustrates a cross-sectional view of the second embodiment of the article of footwear 20 taken along line Y-Y of FIG. 12A, while FIG. 14B illustrates a cross-sectional view of the second embodiment of the article of footwear 20 taken along line Z-Z of FIG. 12A. Similar to the first embodiment 10, the second embodiment 20 includes a forefoot end 22, a heel end 24, a medial side 26, and a lateral side 28. Furthermore, the second embodiment 20 also includes an upper 700, a midsole 800, and an outsole 900. As illustrated, the upper 700 is disposed atop the midsole 800, which is disposed atop the outsole 900. Similar to the upper 100 of the first embodiment 10, the upper 700 includes a forefoot region 710, a heel region 720, and a middle region or arch region 730 disposed between the forefoot region 710 and the heel region 720. Similar to the midsole 200 of the first embodiment 10, the midsole 800 also contains a forefoot region 810, a heel region 820, and an arch region 830. The midsole 800 further includes a front end 840, a rear end 842, a medial side 844, and a lateral side 846. Unlike the midsole 200 of the first embodiment 10, however, the midsole 800 includes an upper portion 850 and a lower portion 860. Nevertheless, similar to the first embodiment 10 of the article of footwear, the midsole 800 is shaped and structured such that the upper 700 is configured to continuously and uniformly wrap around at least the arch of the foot of the user and allow the arch to more naturally flex. While the second embodiment 20 depicted in the figures (including FIGS. 10, 11A, 11B, 12A, 12B, 13, 14A, and 14B) show an article of footwear configured for a right foot, it is noted that the same or similar features can also be provided for an article of footwear configured for a left foot (where such features of the left footed article of footwear are reflection or "mirror image" symmetrical in relation to the right footed article of footwear, e.g., the second embodiment 20 depicted in FIGS. 10, 11A, 11B, 12A, 12B, 13, 14A, and 14B).

Figure 11A:
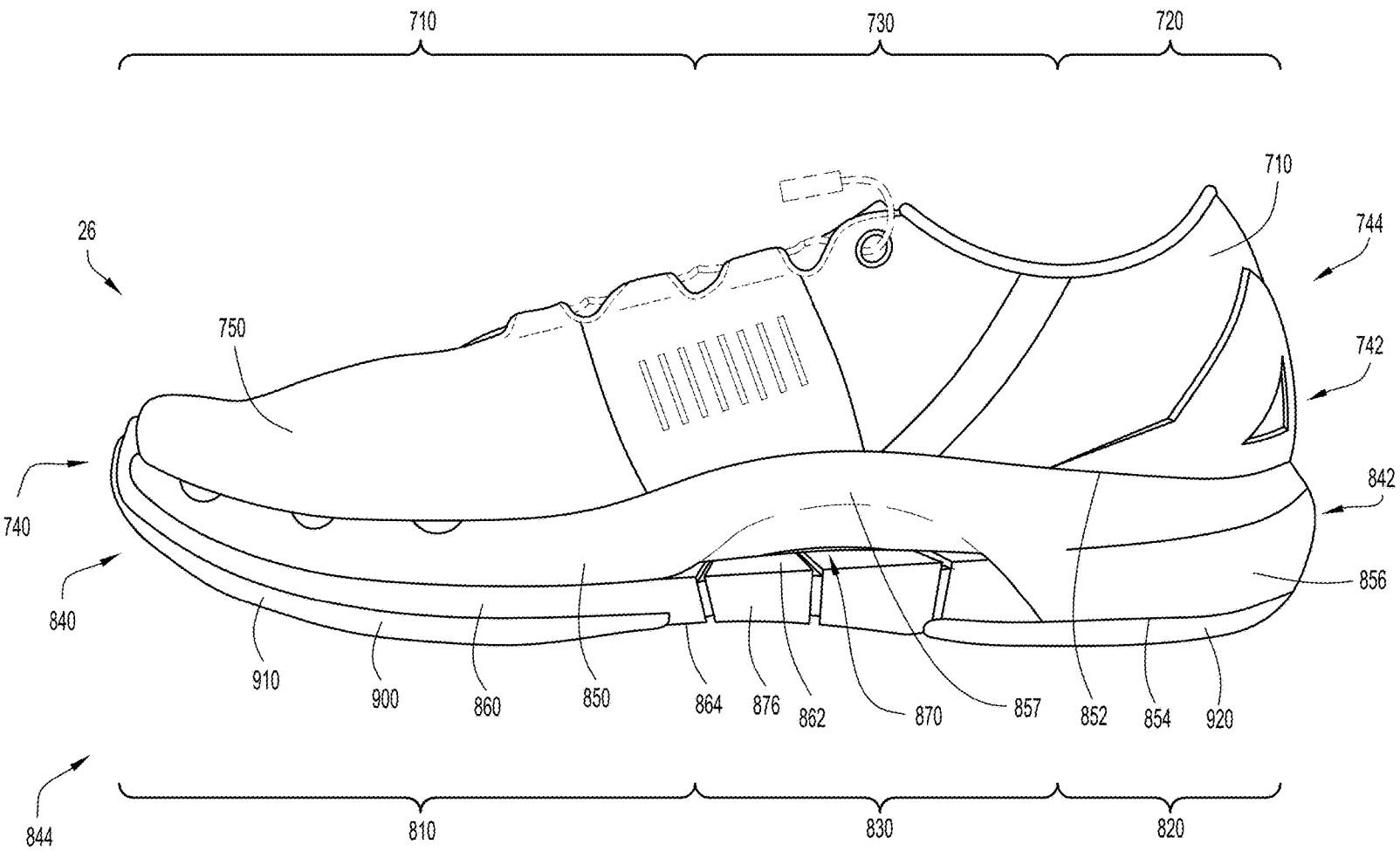
FIG. 11A illustrates a side view of the medial side of the embodiment of the article of footwear illustrated in FIG. 10.
Figure 11B:
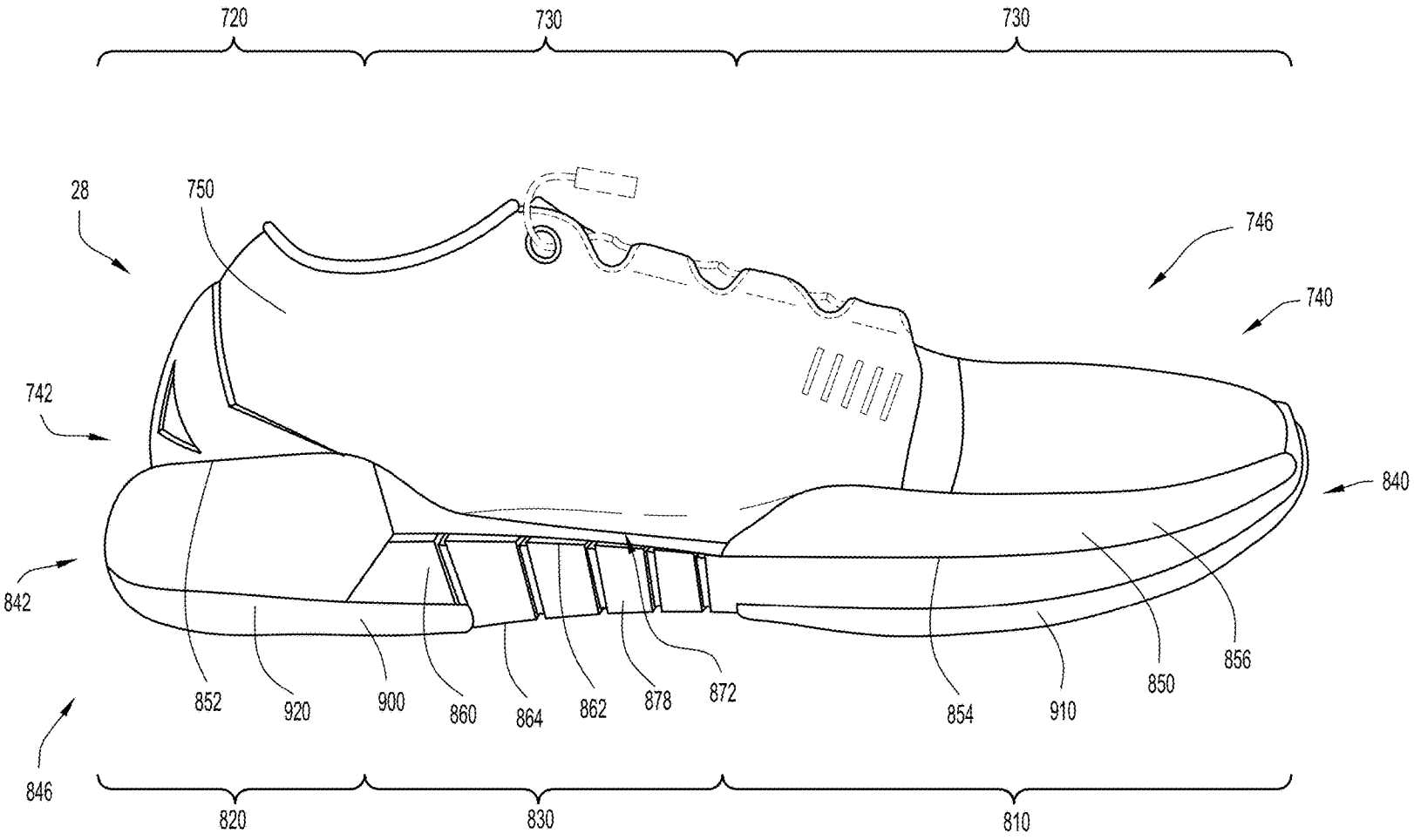
FIG. 11B illustrates a side view of the lateral side of the embodiment of the article of footwear illustrated in FIG. 10.

As previously explained, the midsole 800 of the second embodiment 20 includes an upper portion 850 and a lower portion 860. The upper portion 850 of the midsole 800 is located within the forefoot region 810, heel region 820, and arch region 830. The upper portion 850 further includes a top surface 852, a bottom surface 854, and a sidewall 856. As best illustrated in FIGS. 11A and 11B, the sidewall 846 thickness, or distance between the top surface 852 and the bottom surface 854 of the upper portion 850 of the midsole 800 varies from the forefoot region 810 to the heel region 820. The sidewall 856 in the forefoot region 810 is thinner than the sidewall 856 in the heel region 820. In other words, the sidewall 856 has a larger height in the heel portion 820 of the upper portion 850 than in the sidewall 856 in the forefoot portion 810. As best illustrated in FIG. 14A, and similar to that of the midsole 200 of the first embodiment 10, the upper portion 850 of the midsole 800 of the second embodiment 20 is not disposed on the lateral side 846 in the arch region 830. Unlike the midsole 200 of the first embodiment 10, however, the upper portion 850 of the midsole 800 is at least partially disposed on the medial side 844 in the arch region 830. FIGS. 11A and 14A illustrate that the upper portion 850 includes a segment 857 that extends around the upper 700 on the medial side 844 in the arch region 830 of the midsole 800. The segment 857 of the upper portion 850 is reduced in thickness, or thinner, compared to the sidewalls 856 of the upper portion 850 in other locations. By locating the segment 857 of the upper portion 850 of the midsole 800 on the medial side 844 of the midsole 800, the arch of a foot disposed within the second embodiment 20 of the article of footwear is provided with further support in relation to the first embodiment 10 of the article of footwear. The thinness of the segment 857 still enables the arch of the foot to flex more than in the conventional article of footwear 600 illustrated in FIG. 9A, and still allows the upper 700 to completely wrap around the foot in the arch region 730.

As further illustrated in FIGS. 12A, 12B, and 14A, integrally formed with the upper portion 850 of the midsole 800 in the arch region 830 of the midsole 800 is a support member 858. The support member 858 is configured to be disposed in the arch region 830 of the midsole 800 and spaced from the medial and lateral sides 844, 846 of the midsole 800. The support member 858 extends downwardly from the top surface 852 of the upper portion 850, and tapers from the top surface 852 toward the bottom surface 854. In other words, the support member 858 is wider proximate the top surface 852 of the upper portion 850 than proximate the bottom surface 854. The bottom surface 854 of the upper portion 850 of the midsole 800 at the support member 858 is configured to contact a support surface and support the arch of the foot of a user. As best illustrated in FIG. 14A, similar to that of the support member 300 of the first embodiment 10, the support member 858 is offset from central lengthwise plane D such that more of the support member 858 is disposed toward the lateral side 846 of the midsole 800 than to the medial side 844 of the midsole 800. Thus, the support member 858 is configured to provide more support for the portion of the foot that is closer to the lateral side 28 of the second embodiment 20 of the article of footwear than to the medial side 26 of the second embodiment 20 of the article of footwear.

The upper portion 850 of the midsole 800 may be constructed from a thermoplastic or thermoset material, such as an EVA foam material that is configured to compress on impact and provide cushion to the user's foot as the second embodiment 20 of the article of footwear impacts a support surface. In the second embodiment 20 illustrated, the upper portion 850 may be constructed to have a durometer value of approximately 45 C with a variance of ±3 C. By constructing the upper portion 850 with a durometer value in this range, the segment 857 of the upper 850 is able to provide support to the arch of the foot, while also flexing when enough force is applied.

As previously described, the midsole 800 further includes a lower portion 860. The lower portion 860 may include a top surface 862 and a bottom surface 864, similar to that of the upper portion 850. Unlike the upper portion 850, however, the lower portion 860 of the midsole 800 may be in the shape of a continuous loop that is elongated (e.g., having an elliptical or elongated loop shape), which is best illustrated in FIGS. 11A, 11B, 12A and 12B. The lower portion 860 may be coupled to the upper portion 850 primarily within forefoot region 810 and arch region 830 of the midsole 800. As best illustrated in FIGS. 11A and 11B, the top surface 862 of the lower portion 860 may be at least partially coupled to the bottom surface 854 of the upper portion 850. More specifically, the top surface 862 of the lower portion 860 may be coupled to the bottom surface 854 of the upper portion 850 in the forefoot region 810 of the midsole 810 and in the portion of the arch region 830 that is proximate to the heel region 820. As illustrated in FIGS. 11A, 11B, and 14B, because the lower portion 860 has a continuous loop shape, the top surface 862 of the lower portion 860 may only be coupled to the bottom surface 854 of the upper portion 850 along the medial and lateral sides 844, 846 and around the front end 840 of the forefoot region 810 of the midsole 800. As best illustrated in FIGS. 12A and 12B, the rear end of the lower portion 860 curves from the medial side 844 to the lateral side 846 through the arch region 830 of the midsole 800 that is proximate to the heel region 820. The lower portion 860 may be coupled to the upper portion 850 via any means known, including, but not limited to, adhesives, co-molding, injection molding, etc.

Furthermore, because the upper portion 850 of the midsole 800 is not disposed on the lateral side 846 of the arch region 830, and because of the thinness of the segment 857 of the upper portion 850 on the medial side 844 in the arch region 830, the top surface of the lower portion 860 is exposed on both the medial and lateral sides 844, 846 of the midsole 800 in the arch region 830. As illustrated in FIGS. 11A and 14A, the lower portion 860 of the midsole 800 is disposed away from the upper portion 850 of the midsole 800 on the medial side 844 in the arch region 830 such that the spacing of the lower portion 860 from the segment 857 of the upper portion 850 defines a first opening 870 on the medial side 26 of the footwear 20. As illustrated in FIGS. 11B and 14A, the lower portion of the midsole 800 is disposed away from the upper 700 on the lateral side 846 in the arch region 830 such that the spacing of the lower portion 860 from the upper 700 defines a second opening 872 on the lateral side 28 of the footwear 20. In addition, as best illustrated in FIGS. 12A and 12B, the continuous loop shape of the lower portion 860 defines a central opening 874, which the support member 858 extends through in the arch region 830 of the midsole 800 to contact the support surface. The first opening 870 and the central opening 874 are in fluid communication with one another and define the first extension member 876 of the midsole 800. The first extension member 876 is the segment of the lower portion 860 of the midsole 800 on the medial side 844 with both the upper and lower surfaces 862, 864 exposed. Similarly, the second opening 872 and the central opening 874 are in fluid communication with one another and define the second extension member 878. The second extension member 878 is the segment of the lower portion 860 of the midsole 800 on the lateral side 846 with both the upper and lower surfaces 862, 864 exposed. Unlike the first embodiment 10 of the article of footwear, the extension members 876, 878 may be of the same width. Furthermore, the support member 858 of the second embodiment 20 of the article of footwear may fill a larger portion of the central opening 874 than the support member 300 of the first embodiment 10 of the article of footwear fills of central opening 232. Thus, support member 858 may provide more arch support than support member 300, but may limit the amount of arch flexing compared to that of support member 300.

The lower portion 860 of the midsole 800 may be constructed from a thermoplastic or thermoset material, such as an EVA foam material that is configured to compress on impact and provide cushion to the user's foot as the second embodiment 20 of the article of footwear impacts a support surface. In the second embodiment 20 illustrated, the lower portion 860 may be constructed to have a durometer value of approximately 55 C with a variance of ±3 C. Thus, the lower portion 860 of the midsole 800 is less flexible than the upper portion 850 of the midsole 800.

As best illustrated in FIGS. 10, 11A, 11B, 14A, and 14B, the upper 700 is coupled to the top surface 852 of the upper portion 850 of the midsole 800. Similar to the upper 100 of the first embodiment 10 of the article of footwear, the upper 700 of the second embodiment 20 may be constructed from various materials that are configured to conform and contour to a foot that is placed within the second embodiment 20 of the article of footwear. The various materials that may be used to construct the upper 700 may include, but are not limited to, leather, synthetic leather, rubber, textile fabrics (e.g., breathable fabrics, mesh fabrics, synthetic fibers, etc.), etc. The upper 700 may include a front end 740, a rear end 742, a medial side 744, and a lateral side 746. The upper 700 may further include an exterior surface 750 and an interior surface 760. As best illustrated in FIG. 13, the upper 700 defines a cavity 770 that is configured to receive a foot of a user. Similar to the upper 100 of the first embodiment 10 of the article of footwear, the upper 700 is further configured continuously wrap around at least the bottom of the foot placed within the cavity 770, especially in the arch region 730 of the upper 700. As illustrated in FIG. 13, the interior surface 760 of the upper 700 forms a continuous uniform surface that extends around the bottom of the foot from the medial side 744 to the lateral side 746. The exterior surface 750 of the upper 700 may be disposed on and secured to the top surface 852 of the upper portion 850 of the midsole 800. This may be accomplished by any means known, including, but not limited to, adhesives, co-molding, injection molding, stitching, welting, etc. In the second embodiment 20 of the article of footwear, the exterior surface 750 of the upper 700 may be secured to the top surface 852 of the upper portion 850 of the midsole 800 by an adhesive.

The outsole 900 of the second embodiment 20 of the article of footwear may include a forefoot portion 910 and a heel portion 920. The forefoot portion 910 of the outsole 900 may be coupled to the upper portion 850 and the lower portion 860 in the forefoot region 810 of the midsole 800. More specifically, the forefoot portion 910 of the outsole 900 may be coupled to the bottom surface 854 of the upper portion 850 and the bottom surface 864 of the lower portion 860 in the forefoot region 810 of the midsole 800. Because the lower portion 860 is disposed only along the medial and lateral sides 844, 846 and around the front end 840 of the midsole 800, as best illustrated in FIG. 14B, the forefoot portion 910 of the outsole 900 is secured to both the upper portion 850 and the lower portion 860. As illustrated in FIG. 12A, the forefoot portion 910 is configured to cover the entire forefoot region 810 of the midsole 800, from the medial side 844 to the lateral side 846, and from the front end 840 to the intersection between the forefoot region 810 and the arch region 830.

The heel portion 920 is predominately disposed in the heel region 820 of the midsole 800. The heel portion 910 of the outsole 900 may be coupled to both the upper portion 850 and the lower portion 860 of the midsole 800 in the heel region 820 of the midsole 800. Similar to that of the forefoot portion 910, the heel portion 920 of the outsole 900 may be coupled to the bottom surface 854 of the upper portion 850 and the bottom surface 864 of the lower portion 860 in the heel region 820 of the midsole 800. Because the lower portion 860 does not extend entirely through the heel region 810 (i.e., the lower portion 860 curves from the medial side 844 to the lateral side 846 before the rear end 842 of the midsole 800), the heel portion 920 of the outsole 900 is secured to both the upper portion 850 and the lower portion 860. As illustrated in FIG. 12A, the heel portion 920 is configured to cover the entire heel region 820 of the midsole 800, from the medial side 844 to the lateral side 846, and from the rear end 842 to the intersection between the heel region 820 and the arch region 830. As further illustrated, the heel portion 920 includes a medial projection 922 and a lateral projection 924 that extend forward into the arch region 830 of the midsole 800. The medial projection 922 extends partially into the arch region 830 of the midsole 800 along the medial side 844 of the midsole 800, while the lateral projection 924 extends partially into the arch region 830 of the midsole 800 along the lateral side 846 of the midsole 800.

The outsole 900 may be constructed from a material that is durable and contains a durometer value greater than the upper and lower portions 850, 860 of the midsole 800. In the second embodiment 20 of the article of footwear, the outsole 900 may be constructed from a rubber with a durometer value of 60 A and a variance of ±3 A. In other embodiments, the durometer value of the outsole 900 may be greater or lesser than 60 A. In another embodiment, the durometer values of the forefoot portion 910 of the outsole 900 may differ from that of the heel portion 920 of the outsole 900.

While the midsole 800 and outsole 900 of the second embodiment 20 of the article of footwear differs from the midsole 200 and outsole 500 of the first embodiment 10 of the article of footwear, both embodiments 10, 20 provide similar features of providing arch support as described herein. As described herein, both embodiments 10, 20 of the article of footwear have midsoles 200, 800 that have limited to no contact with the uppers 100, 700 in the arch regions 230, 830 of the midsoles 200, 800. While the midsole 800 of the second embodiment 20 contains two portions 850, 860 compared to the one midsole 200 of the first embodiment 10, the midsoles 200, 800 of the two embodiments 10, 20 both include first openings or recesses 234, 870, second openings or recesses 238, 872, and central openings 232, 874. Furthermore, the midsoles 200, 800 of the two embodiments 10, 20 contain first extension members 236, 876 and second extension members 240, 878. In addition, both embodiments 10, 20 have support members 300, 858 coupled to the bottom of the uppers 100, 700 in the arch regions 130, 730 of the uppers 100, 700, and are configured to extend downwardly from the uppers 100, 700 to contact a support surface and provide arch support to feet placed within the uppers 100, 700.

By reducing the amount of midsole 200, 800 in the arch regions 230, 830 of the articles of footwear 10, 20, the uppers 100, 700 are able to be constructed to continuously wrap around at least the arch of the foot placed within the articles of footwear 10, 20. This enables the arch of the foot to more naturally flex during movements (i.e., running, walking, jumping, etc.) because the arch is less inhibited from flexing like that of the midsole 620 of the conventional shoe 600. While the second embodiment includes segment 857 of the upper portion 850 of the midsole 800 disposed on the medial side 744 of the upper 700 in the arch region 730, the durometer value of the upper portion 850 of the midsole 800 and the thinness of the segment 857 of the upper portion 850 of the midsole 800 still enable the arch of the foot on the medial side 26 of the second embodiment 20 of the article of footwear to flex. An arch of a foot in the second embodiment 20 of the article of footwear may not be able to flex as freely as an arch of a foot in the first embodiment 10 of the article of footwear, which contains no midsole on the medial side 146 of the upper 100, but the second embodiment 20 of the article of footwear enables an arch of a foot on the medial side 26 of the second embodiment 20 to flex more freely than that of the conventional shoe 600. The additional support of the segment of the upper portion 850 of the midsole 800 of the second embodiment 20 may be useful when a user is performing more intensive movements (e.g., cross-training, basketball, etc.), where cutting motions are more likely to be made by a user. While the first embodiment 10 of the article of footwear may be sufficient for repeated movements and foot strikes (i.e., running, jogging, etc.), the second embodiment 20, with additional midsole 800 structure may be better suited for more random and varied movements and foot strikes (e.g., cross-training, basketball, etc.). The additional covering of the outsole 900 of the second embodiment 20 compared to that of the outsole 500 of the first embodiment 10 makes the second embodiment 20 more durable than the first embodiment 10 while still enabling the second embodiment 20 to function similar to that of the first embodiment 10.

Not only does having the upper 100, 700 continuously wrap around the arch of the foot enable the arch to more freely flex, but it also allows the upper 100, 700, and ultimately the article of footwear 10, 20, to fit a wider range of feet. By limiting the connection of the midsole 200, 800 to the upper 100, 700 in the arch region 230, 830, the flexible, and sometimes resilient, upper 100, 700 is free to conform to the specific and individual shape of the arch of the foot placed within the article of footwear 10, 20. This enables the article of footwear 10, 20 to provide a more comfortable fit to a larger amount of users than the conventional footwear 600. The upper 100, 700 of the article of footwear 10, 20 provides a more dynamic fit than that of the conventional footwear 600, where arch support is determined based on the static shape of the midsole 620 and the insole 640.

As previously stated, both embodiments 10, 20 of the article of footwear include a support member 300, 858 that extends downwardly from the bottom of the upper 100, 700 to provide arch support to the foot placed within the upper 100, 700. As illustrated in FIGS. 9B and 14A, both support members 300, 858 are asymmetrical along a lengthwise central axis of the article of footwear, with the majority of the support member 300, 858 being aligned offset from the center lengthwise planes C, D. Both support members 300, 858 are aligned closer to the lateral side 256, 846 than the medial side 254, 844. Support members 300, 858 prevent the foot from hyper-extending and the arch of the foot from collapsing. By asymmetrically supporting the arch of the foot within the upper 100, 700 of the article of footwear 10, 20, the arch of the foot remains supported, but is able to flex on the medial side 254, 844. This results in a stronger arch that is less susceptible to injury. As previously d the segment 857 of the upper portion 850 of the midsole of the second embodiment 20 allows the arch to flex on the medial side 844 while providing additional support for more intensive movements.

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. An article of footwear comprising:

an upper; and a sole structure coupled to a bottom of the upper, the sole structure comprising:

a midsole including a forefoot region, a heel region, and a middle region disposed between the forefoot region and the heel region, the midsole including a first portion and a second portion, the second portion being disposed on a bottom of the first portion, the midsole comprising:

a bottom opening disposed through the midsole and located in at least the forefoot region and the middle region, a first side opening disposed on a medial side of the midsole in the middle region, and a second side opening disposed on a lateral side of the midsole in the middle region, the bottom opening being in fluid communication with the first side opening and second side opening, a support member coupled to the bottom of the upper and extending through the bottom opening of the midsole, the support member being configured to contact a ground surface, the support member being integrally formed with the first portion of the midsole, and an outsole disposed on a bottom surface of the midsole beneath the forefoot region and the heel region, wherein a portion of the upper proximate the middle region of the midsole is configured to flex and contour to an arch of a foot disposed within the upper as the arch flexes.

2. The article of footwear of claim 1, wherein the midsole further comprises a continuous first extension member on the medial side of the midsole, the first extension member extending through the middle region from the forefoot region to the heel region proximate to the bottom opening and the first side opening of the midsole.

3. The article of footwear of claim 2, wherein the midsole further comprises a continuous second extension member on the lateral side of the midsole, the second extension member extending through the middle region from the forefoot region to the heel region proximate to the bottom opening and the second side opening of the midsole.

4. The article of footwear of claim 3, wherein the first extension member and the second extension member are spaced from the upper.

5. The article of footwear of claim 1, wherein the support member is disposed asymmetrically in relation to a central lengthwise axis of the article of footwear.

6. The article of footwear of claim 5, wherein the support member is disposed closer to the lateral side of the midsole than to the medial side of the midsole.

7. The article of footwear of claim 1, wherein the support member contains a first durometer value and the midsole contains a second durometer value, the second durometer value being greater than the first durometer value.

8. The article footwear of claim 1, wherein the forefoot region of the midsole comprises at least one depression in the bottom surface of the midsole, the at least one depression extending from the medial side to the lateral side of the midsole.

9. The article of footwear of claim 8, further comprising a flexible member coupled within the at least one depression.

10. The article of footwear of claim 9, wherein the flexible member contains a first durometer value and the midsole contains a second durometer value, the second durometer value being greater than the first durometer value.

11. The article of footwear of claim 1, wherein the first portion of the midsole contains a first durometer value and the second portion of the midsole contains a second durometer value, the second durometer value being greater than the first durometer value.

12. The article of footwear of claim 1, wherein the second portion of the midsole forms an elongated loop that extends between the forefoot region and the middle region of the midsole.

13. The article of footwear of claim 12, wherein the bottom opening is disposed in the second portion of the midsole.

14. The article of footwear of claim 1, wherein the first side opening is disposed in the first portion of the midsole and in the second portion of the midsole.

15. The article of footwear of claim 1, wherein the second side opening is outlined by the second portion of the midsole and the upper.

16. The article of footwear of claim 1, wherein the second portion of the midsole includes a first extension member on the medial side of the midsole, the first extension member extending through the middle region from the forefoot region to the heel region proximate the bottom opening and the first side opening.

17. The article of footwear of claim 16, wherein the second portion of the midsole further includes a second extension member on the lateral side of the midsole, the second extension member extending through the middle region from the forefoot region to the heel region proximate the bottom opening and the second side opening.

* * * * *